US009570081B2

(12) United States Patent
Vilermo et al.

(10) Patent No.: US 9,570,081 B2
(45) Date of Patent: Feb. 14, 2017

(54) BACKWARDS COMPATIBLE AUDIO REPRESENTATION

(75) Inventors: Miikka Vilermo, Siuro (FI); Mikko Tammi, Tampere (FI)

(73) Assignee: Nokia Technologies Oy, Espoo (FI)

( * ) Notice: Subject to any disclaimer, the term of this patent is extended or adjusted under 35 U.S.C. 154(b) by 305 days.

(21) Appl. No.: 14/396,638

(22) PCT Filed: Apr. 26, 2012

(86) PCT No.: PCT/IB2012/052090

§ 371 (c)(1),
(2), (4) Date: Jan. 20, 2015

(87) PCT Pub. No.: WO2013/160729

PCT Pub. Date: Oct. 31, 2013

(65) Prior Publication Data

US 2015/0179179 A1 Jun. 25, 2015

(51) Int. Cl.

| | |
|---|---|
| ***G10L 19/008*** | (2013.01) |
| ***H04S 5/02*** | (2006.01) |
| ***H04S 3/00*** | (2006.01) |
| ***H04S 3/02*** | (2006.01) |
| *G10L 19/02* | (2013.01) |

(52) U.S. Cl.
CPC ..... *G10L 19/008* (2013.01); *G10L 19/0204* (2013.01)

(58) Field of Classification Search
CPC .... G10L 19/008; G10L 19/0204; G10L 19/00; G10L 19/02; H04S 2420/03; H04S 2400/03
USPC ..... 381/17–19, 22, 23
See application file for complete search history.

(56) References Cited

U.S. PATENT DOCUMENTS

| | | | | |
|---|---|---|---|---|
| 5,291,557 | A * | 3/1994 | Davis | H04S 3/02 381/22 |
| 2009/0116652 | A1 | 5/2009 | Kirkeby et al. | |
| 2010/0119072 | A1 | 5/2010 | Ojanpera | |
| 2012/0128174 | A1 | 5/2012 | Tammi et al. | |
| 2013/0044884 | A1 | 2/2013 | Tammi et al. | |

FOREIGN PATENT DOCUMENTS

| | | |
|---|---|---|
| WO | 2010091736 | 8/2010 |

OTHER PUBLICATIONS

International Search Report and Written Opinion received for corresponding Patent Cooperation Treaty Application No. PCT/IB2012/052090 , mailed Feb. 26, 2013, 13 pages.

* cited by examiner

*Primary Examiner* — George Monikang
(74) *Attorney, Agent, or Firm* — Nokia Technologies Oy

(57) ABSTRACT

It is inter alia disclosed to provide a left signal representation associated with a left audio channel and a right signal representation associated with a right audio channel, each of the left and right signal representations being associated with a plurality of subbands of a frequency range, and to provide directional information associated with at least one subband of the plurality of subbands associated with the left and the right signal representation, the directional information being at least partially indicative of a direction of a sound source with respect to the left and right audio channel.

16 Claims, 10 Drawing Sheets

BACKWARDS COMPATIBLE AUDIO REPRESENTATION

RELATED APPLICATION

This application was originally filed as PCT Application No. PCT/IB2012/052090 filed Apr. 26, 2012.

FIELD

Embodiments of this invention relate to the field of audio signal processing.

BACKGROUND

In audio processing it is well-known to provide binaural or multichannel audio based on a two-channel spatial audio representation, which is created from microphone inputs.

This two-channel spatial audio representation may be rendered to different listening equipment. For instance, such a listening equipment may be a headphone surround equipment (binaural) or a 5.1 or 7.1 or any other multichannel surround equipment.

Said two-channel spatial audio representation may comprise a direct audio component and an ambient audio component, wherein this direct and ambient audio component can be used as basis for rendering the two-channel spatial audio representation to the desired listening equipment. The direction component may represent a mid signal component and the ambient component may represent a side signal component.

SUMMARY OF SOME EMBODIMENTS OF THE INVENTION

In the two-channel spatial audio representation the direct-channel represent the direct component of the sound filed and the ambient-channel represents the ambient component of the sound filed. These components cannot be directly played back over loudspeakers or over headphones, and thus, for instance, obtaining Left/Right-stereo representation from the two-channel audio representation may become a delicate task.

According to a first exemplary embodiment of a first aspect of the invention, a method is disclosed, comprising providing a left signal representation associated with a left audio channel and a right signal representation associated with a right audio channel, each of the left and right signal representations being associated with a plurality of subbands of a frequency range, and providing directional information associated with at least one subband of the plurality of subbands associated with the left and the right signal representation, the directional information being at least partially indicative of a direction of a sound source with respect to the left and right audio channel.

According to a second exemplary embodiment of the first aspect of the invention, an apparatus is disclosed, which is configured to perform the method according to the first aspect of the invention, or which comprises means for performing the method according to the first aspect of the invention, i.e. means for providing a left signal representation associated with a left audio channel and a right signal representation associated with a right audio channel, each of the left and right signal representations being associated with a plurality of subbands of a frequency range, and means for providing directional information associated with at least one subband of the plurality of subbands associated with the left and the right signal representation, the directional information being at least partially indicative of a direction of a sound source with respect to the left and right audio channel.

According to a third exemplary embodiment of the first aspect of the invention, an apparatus is disclosed, comprising at least one processor and at least one memory including computer program code, the at least one memory and the computer program code configured to, with the at least one processor, cause the apparatus at least to perform the method according to the first aspect of the invention. The computer program code included in the memory may for instance at least partially represent software and/or firmware for the processor. Non-limiting examples of the memory are a Random-Access Memory (RAM) or a Read-Only Memory (ROM) that is accessible by the processor.

According to a fourth exemplary embodiment of the first aspect of the invention, a computer program is disclosed, comprising program code for performing the method according to the first aspect of the invention when the computer program is executed on a processor. The computer program may for instance be distributable via a network, such as for instance the Internet. The computer program may for instance be storable or encodable in a computer-readable medium. The computer program may for instance at least partially represent software and/or firmware of the processor.

According to a fifth exemplary embodiment of the first aspect of the invention, a computer-readable medium is disclosed, having a computer program according to the first aspect of the invention stored thereon. The computer-readable medium may for instance be embodied as an electric, magnetic, electro-magnetic, optic or other storage medium, and may either be a removable medium or a medium that is fixedly installed in an apparatus or device. Non-limiting examples of such a computer-readable medium are a RAM or ROM. The computer-readable medium may for instance be a tangible medium, for instance a tangible storage medium. A computer-readable medium is understood to be readable by a computer, such as for instance a processor.

In the following, features and embodiments pertaining to all of these above-described embodiments of the first aspect of the invention and of a second and third aspect of the invention will be briefly summarized.

For instance, the apparatus may represent a mobile terminal (e.g. a portable device, such as for instance a mobile phone, a personal digital assistant, a laptop or tablet computer, to name but a few examples) or a stationary apparatus.

A left signal representation associated with a left audio channel and a right signal representation associated with a right audio channel is provided, wherein each of the left and right signal representations is associated with a plurality of subbands of a frequency range.

Thus, for instance, in a frequency domain the left signal representation and the right signal representation may each comprise a plurality of subband components, wherein each of the subband components is associated with a subband of the plurality of subbands. For instance, a frequency range in the frequency domain may be divided into the plurality of subbands. Nevertheless, the left and right signal representation may be a representation in the time domain or a representation in the frequency domain, and it has to be understood that even in the time domain the left and right signal representation comprise the plurality of subband components.

For instance, the left audio channel may represent a signal captured by a first microphone and the second audio channel may represent a signal captured by a second microphone.

Furthermore, directional information associated with at least one subband of the plurality of subbands associated with the left and the right signal representation is provided, the directional information being at least partially indicative of a direction of a sound source with respect to the left and right audio channel. For instance, the at least one subband of the plurality of subbands may represent a subset of subbands of the plurality of subbands or may represent the plurality of subbands associated with the left and the right signal representation.

As an example, the directional information associated with the at least one subband may represent any information which can be used to generate a spatial audio signal subband representation associated with a subband of the at least one subband based on the left signal representation, on the right signal representation, and on the directional information associated with the respective subband.

For instance, the directional information may be indicative of the direction of a dominant sound source relative to the first and second microphone for a respective subband of the at least one subband of the plurality of subbands.

Furthermore, the method according to a first exemplary embodiment of the first aspect of the invention may comprise determining an encoded representation of the left signal representation, of the right signal representation, and of the directional information. Thus, the encoded representation may comprise an encoded left signal representation of the left signal representation, an encoded right signal representation of the right signal representation, and an encoded directional information of the direction information.

Thus, as an example, the encoded representation may be transmitted via a channel to a corresponding decoder, wherein the decoder may be configured to decode the encoded representation and to determine a spatial audio signal representation based on the encoded representation, i.e. based on the left and right signal representation and based on the directional information. For instance, exemplary embodiments of such a decoder will be explained with respect to the second aspect of the invention.

Furthermore, since the right signal representation is associated with the right audio signal and since the left signal representation is associated with the left audio signal, it is possible to generate or obtain a Left/Right-stereo representation of audio based on the left and right signal representation. Thus, although the encoded representation may be used for determining a spatial audio representation, this encoded representation is completely backwards compatible, i.e. it is possible to generate or obtain a Left/Right-stereo representation of audio based on the encoded representation.

According to an exemplary embodiment of all aspects of the invention, said left audio channel is captured by a first microphone and said right audio channel is captured by a second microphone of two or more microphones arranged in a predetermined geometric configuration.

A first microphone is configured to capture a first audio signal. For instance, the first microphone may be configured to capture the left audio channel. Furthermore, a second microphone is configured to capture a second audio signal. For instance, the second microphone may be configured to capture the right audio channel. The first microphone and the second microphone are positioned at different locations.

For instance, the first microphone and the second microphone may represent two microphones of two or more microphones, wherein said two or more microphones are arranged in a predetermined geometric configuration. As an example, the two or more microphones may represent ommnidirectional microphones, i.e. the two or more microphones are configured to capture sound events from all directions, but any other type of well suited microphones may be used as well.

Furthermore, as an example, an example a microphone arrangement may comprises an optional third microphone which is configured to capture a third audio signal. For instance, in this example of a microphone arrangement, the three or more microphones are arranged in a predetermined geometric configuration having an exemplary shape of a triangle with vertices separated by distance d, wherein the three microphones are arranged on a plane in accordance with the geometric configuration. It has to be understood different microphone setups and geometric configurations may be used. For instance, the optional third microphone may be used to obtain further information regarding the direction of the sound source with respect to the two or more microphones arranged in a predetermined geometric configuration.

According to an exemplary embodiment of all aspects of the invention, the directional information is indicative of the direction of the sound source relative to the first and second microphone for a respective subband of the at least one subband of the plurality of subbands associated with the left and the right signal representation.

According to an exemplary embodiment of all aspects of the invention, the directional information comprises an angle representative of arriving sound relative to the first and second microphones for a respective subband of the at least one subband of the plurality of subbands associated with the first and the second signal representation.

For instance, the directional information may comprise an angle $\alpha_b$ representative of arriving sound relative to the first microphone and second microphone for a respective subband b of the at least one subband of the plurality of subbands associated with the left and right signal representation. As an example, the angle $\alpha_b$ may represent the incoming angle $\alpha_b$ with respect to one microphone of the two or more microphones, but due to the predetermined geometric configuration of the at least two microphone, this incoming angel $\alpha_b$ can be considered to represent an angle $\alpha_b$ indicative of the sound source relative to the first and second microphone for a respective subband b.

As an example, the directional information may be determined by means of a directional analysis based on the left and right signal representation.

For instance, the directional analysis may be performed for each subband of at least one subband of the plurality of subband in order to determine the respective directional information associated with a respective subband of the at least one subband.

As an example, a plurality of subband components of the left signal representation and of the right signal representation are obtained. For instance, the subband components may be in the time-domain or in the frequency domain. In the sequel, it may be assumed without any limitation the subband components are in the frequency domain.

For instance, a subband component of a kth signal representation may denoted as $X_k^b(n)$. As an example, the kth signal representation in the frequency domain may be divided into B subbands $$X_k^b(n)=x_k(n_b+n),\ n=0,K\ n_{b+1}-n_b-1,\ b=0,K,B-1, \tag{1}$$

where $n_b$ is the first index of bth subband. The width of the subbands may follow, for instance, the equivalent rectangular bandwidth (ERB) scale.

The directional analysis for a respective subband is performed based on the respective subband component of the left signal representation $X_1^b(n)$ and based on the respective subband component of the right signal representation $X_2^b(n)$. Furthermore, for instance, the directional analysis may be performed on the subband components of at least one further signal representation, e.g. $X_3^b(n)$, and/or on further additional information, e.g. additional information on the geometric configuration of the two or more microphones and/or the sound source.

For instance, the directional analysis may determine a direction, e.g. the above-mentioned angle $\alpha_b$, of the (e.g., dominant) sound source.

According to an exemplary embodiment of all aspects of the invention, the directional information comprises a time delay for a respective subband of the at least one subband of the plurality of subbands associated with the first and the second signal representation, the time delay being indicative of a time difference between the first signal representation and the second signal representation with respect to the sound source for the respective subband.

For instance, said time delay being indicative of a time difference between the first signal representation and the second signal representation with respect to the sound source for the respective subband may represent a time delay that provides a good or maximized similarity between the respective subband component of one of the left and right signal representation shifted by the time delay and the respective subband component of the other of the left or right signal representation.

As an example, said similarity may represent a correlation or any other similarity measure.

For instance, this time delay may be assumed to represent a time difference between the frequency-domain representations of the left and right signal representations in the respective subband.

Thus, for instance, as a non-limiting example, it may be the task to find a time delay $\tau_b$ that provides a good or maximized similarity between the time-shifted left signal representation $X_{1,\tau_b}^b(n)$ and the right signal representation $X_2^b(n)$, or, to find a time delay $\tau_b$ that provides a good or maximized correlation between the time-shifted right signal representation $X_{2,\tau_b}^b(n)$ and the right signal representation $X_1^b(n)$. The time-shifted representation of a kth signal representation $X_k^b(n)$ may be expressed as $$X_{k,\tau_b}^b(n) = X_k^b(n)e^{-j\frac{2\pi\tau_b}{N}}. \tag{2}$$

As a non-limiting example, the time delay $\tau_b$ may be obtained by using a maximization function that maximises the correlation between $X_{1,\tau_b}^b(n)$ and $X_2^b(n)$:

$$\max_{\tau_b} \mathrm{Re}\left(\sum_{n=0}^{n_{b+1}-n_b-1} X_{1,\tau_b}^b(n) * X_2^b(n)\right), \tau_b \in [-D_{max}, D_{max}], \tag{3}$$

where Re indicates the real part of the result and * denotes complex conjugate. $X_1^b(n)$ and $X_2^b(n)$ may be considered to represent vector with length of $n_{b+1}-n_{b-1}$ samples. Also other perceptually motivated similarity measures than correlation may be used. Thus, a time delay may be determined that provides a good or maximised similarity between a subband component of one of the left and right signal representation shifted by the time delay $\tau_b$ and the respective subband component of the other of the left or right signal representation.

Accordingly, for each subband of the at least one subband of the plurality of subbands a time delay $\tau_b$ being associated with respective subband b may be determined.

Furthermore, as an example, the directional information associated with the respective subband b may be determined based on the determined time delay $\tau_b$ associated with the respective subband b.

For instance, it may be assumed without any limitation with respect to the exemplary geometric constellation of the two or more microphones that the time shift $\tau_b$ may indicate how much closer the dominant sound source is to the first microphone than the second microphone. With respect to this exemplary predefined geometric constellation, when $\tau_b$ is positive, the sound source is closer to the second microphone, and when $\tau_b$ is negative, the sound source is closer to the first microphone. The actual difference in distance $\Delta_{12,b}$ might be calculated as $$\Delta_{12,b} = \frac{v\tau_b}{F_s}. \tag{4}$$

For instance, the angle $\alpha_b$ may be determined based on the predefined geometric constellation and the actual difference in distance $\Delta_{12,b}$.

As an example, with respect to this exemplary predefined geometric constellation, the distance between the second microphone and the sound source may be a and the distance between the first microphone represents $a+\Delta_{12,b}$, wherein the angle $\hat{\alpha}_b$ may for instance be determined based on the following equation:

$$\hat{\alpha}_b = \pm\cos^{-1}\left(\frac{\Delta_{12,b}^2 + 2a\Delta_{12,b} - d^2}{2ad}\right), \tag{5}$$

where d is the distance between the first and second microphone and a may be the estimated distance between the dominant sound source and the nearest microphone. For instance, with respect to equation (5) there are two alternatives for the direction of the arriving sound as the exact direction cannot be determined with only two microphones 201, 202. Thus, further information may be used to determine the correct direction $\alpha_b$.

For instance, the signal captured by the third microphone 203 may be used to determine the correct direction based on the two possible directions obtained by equation (5), wherein the third signal representation $X_3^b(n)$ is associated with the signal captured by the third microphone.

An example technique to define which of the signs in equation (5) is correct may be as follows:

For instance, under the assumption of using a predetermined geometric configuration having an exemplary shape of a triangle with vertices separated by distance d, the distances between the first microphone 201 and the two possible estimated sound sources may be be expressed as $$\delta_b^+ = \sqrt{(h + a\sin(\hat{\alpha}_b))^2 + \left(\frac{d}{2} + \cos a\cos(\hat{\alpha}_b)\right)^2} \text{ and} \tag{6}$$

-continued $$\delta_b^- = \sqrt{(h - a\sin(\hat{\alpha}_b))^2 + \left(\frac{d}{2} + \cos a\cos(\hat{\alpha}_b)\right)^2},$$

wherein h is the height of the equilateral triangle, $$h = \frac{\sqrt{2}}{2}d. \tag{7}$$

The distances in equation (6) equal to delays (in samples)

$$\tau_b^+ = \frac{\delta^+ - a}{v}F_s, \quad \tau_b^- = \frac{\delta^- - a}{v}F_s. \tag{8}$$

For instance, out of these two delays, the one may be selected that provides better correlation or a better similarity between the signal component $X_3^b(n)$ of the respective subband b of the third signal representation and a signal representation being representative or proportional to the signal received at the microphone nearest to the sound source out of the first and second microphone.

For instance, this signal representation being representative or proportional to the signal received at the microphone nearest to the sound source out of the first and second microphone may be denoted as $X_{near}^b(n)$ and may be one of the following:

$$X_{near}^b(n) = \begin{cases} X_1^b(n), & \tau_b \le 0 \\ X_{1,-\tau_b}^b(n), & \tau_b \ge 0 \end{cases}, \tag{9}$$

$$X_{near}^b(n) = \begin{cases} X_{2,\tau_b}^b(n), & \tau_b \le 0 \\ X_2^b(n), & \tau_b \ge 0 \end{cases}, \text{ and}$$

$$X_{near}^b(n) = \begin{cases} \dfrac{X_1^b(n) + X_{2,\tau_b}^b(n)}{2}, & \tau_b \le 0 \\ \dfrac{X_{1,-\tau_b}^b(n) + X_2^b(n)}{2}, & \tau_b \ge 0 \end{cases}.$$

Then, for instance, the correlation (or any similarity measure) may be obtained as $$C_b^+ = \mathrm{Re}\left(\sum_{n=0}^{n_{b+1}-n_b-1} X_{near,\tau_b}^b(n) * X_3^b(n)\right), \tag{10}$$

$$C_b^- = \mathrm{Re}\left(\sum_{n=0}^{n_{b+1}-n_b-1} X_{near,\tau_b}^b(n) * X_3^b(n)\right),$$

and the direction may be obtained of the dominant sound source for subband b:

$$\alpha_b = \begin{cases} \hat{\alpha}_b, & c_b^+ \ge c_b^- \\ -\hat{\alpha}_b, & c_b^+ \le c_b^- \end{cases} \tag{11}$$

It has to be understood that the explained technique to define which of the signs in equation (5) is correct represents an example and that other techniques based on further information and/or based on the captured signal from the third microphone may be used.

Thus, for instance, an angle $\alpha_b$ may be determined as directional information associated with the respective subband b based on the determined time delay $\tau_b$ associated with the respective subband b.

Accordingly, directional information associated with each subband of the at least one subband of the plurality of subbands may be determined.

According to an exemplary embodiment of all aspects of the invention, wherein the directional information comprises at least one of the following distances: a distance indicative of the distance between the first and second microphone, and a distance indicative of the distance between the sound source and a microphone of the first and second microphone.

According to an exemplary embodiment of the first aspect of the invention, an encoded representation comprises: an encoded left signal representation of the left signal representation, an encoded right signal representation of the right signal representation, and the directional information.

For instance, it may be assumed that the left and right signal representations are in the time domain.

The left signal representation may be fed to a first entity for block division and windowing, wherein this entity may be configured to generate windows with a predefined overlap and an effective length, wherein this predefined overlap map represent 50 or another well-suited percentage, and wherein this effective length may be 20 ms or another well-suited length. Furthermore, the first entity may be configured to add $D_{tot}=D_{max}+D_{HRTF}$ zeroes to the end of the window, wherein $D_{max}$ may correspond to the maximum delay in samples between the microphones.

A second entity for block division and windowing may receive the right signal representation and may configured to generate windows with a predefined overlap and an effective length in the same way as first entity.

The windows formed by the first and second entities configured to generate windows with a predefined overlap and an effective length may be fed to a respective transform entity, wherein a first transform entity may be is configured to transform the windows of the left signal representation to frequency domain, and wherein a second transform entity may configured to transform the windows of the right signal representation to frequency domain.

Then quantization and encoding may be performed to the left signal representation in the frequency domain and to the right signal representation in the frequency domain. For instance, suitable audio codes may for instance be AMR-WB+, MP3, AAC and AAC+, or any other audio codec.

Afterwards, the quantized and encoded left and right signal representations may be inserted into a bitstream.

The directional information associated with at least one subband of the plurality of subbands associated with the left and the right signal representation is inserted into the bitstream. Furthermore, for instance, the directional information may be quantized and/or encoded before being inserted in the bitstream.

Accordingly, said bitstream may be assumed to represent said encoded representation comprising an encoded left signal representation of the left signal representation, an encoded right signal representation of the right signal representation, and the directional information.

According to a first exemplary embodiment of a second aspect of the invention, a method is disclosed, comprising determining a audio signal representation based on a left signal representation, on a right signal representation and on directional information, wherein each of the left and right signal representations being associated with a plurality of subbands of a frequency range, and wherein the directional information is associated with at least one subband of the plurality of subbands associated with the left and the right signal representation, the directional information being indicative of a direction of a sound source with respect to the left and right audio channel.

According to a second exemplary embodiment of the second aspect of the invention, an apparatus is disclosed, which is configured to perform the method according to the second aspect of the invention, or which comprises means for determining an audio signal representation based on a left signal representation, on a right signal representation and on directional information, wherein each of the left and right signal representations being associated with a plurality of subbands of a frequency range, and wherein the directional information is associated with at least one subband of the plurality of subbands associated with the left and the right signal representation, the directional information being indicative of a direction of a sound source with respect to the left and right audio channel.

According to a third exemplary embodiment of the second aspect of the invention, an apparatus is disclosed, comprising at least one processor and at least one memory including computer program code, the at least one memory and the computer program code configured to, with the at least one processor, cause the apparatus at least to perform the method according to the second aspect of the invention. The computer program code included in the memory may for instance at least partially represent software and/or firmware for the processor. Non-limiting examples of the memory are a Random-Access Memory (RAM) or a Read-Only Memory (ROM) that is accessible by the processor.

According to a fourth exemplary embodiment of the second aspect of the invention, a computer program is disclosed, comprising program code for performing the method according to the second aspect of the invention when the computer program is executed on a processor. The computer program may for instance be distributable via a network, such as for instance the Internet. The computer program may for instance be storable or encodable in a computer-readable medium. The computer program may for instance at least partially represent software and/or firmware of the processor.

According to a fifth exemplary embodiment of the second aspect of the invention, a computer-readable medium is disclosed, having a computer program according to the first aspect of the invention stored thereon. The computer-readable medium may for instance be embodied as an electric, magnetic, electro-magnetic, optic or other storage medium, and may either be a removable medium or a medium that is fixedly installed in an apparatus or device. Non-limiting examples of such a computer-readable medium are a RAM or ROM. The computer-readable medium may for instance be a tangible medium, for instance a tangible storage medium. A computer-readable medium is understood to be readable by a computer, such as for instance a processor.

Thus, in accordance with the second aspect of the invention, an audio signal representation is determined based on a left signal representation, on a right signal representation and on directional information, wherein each of the left and right signal representations being associated with a plurality of subbands of a frequency range, and wherein the directional information is associated with at least one subband of the plurality of subbands associated with the left and the right signal representation, the directional information being indicative of a direction of a sound source with respect to the left and right audio channel.

For instance, the left signal representation, the right signal representation, and the directional information may represent the left and right signal representation provided by the first aspect of the invention. For instance, any explanation presented with respect to the right and left signal representation and to the directional information in the first aspect of the invention may also hold for the right and left signal representation and the directional information of the second aspect of the invention.

For instance, said audio signal representation may comprise a plurality of audio channel representations. For instance, said plurality of audio channel signal representations may comprise two audio channel signal representations, or it may comprise more than two audio channel signal representations. As an example, said audio signal representation may represent a spatial audio signal representation. The plurality of audio channel representations may for instance by determined based on the first and second signal representation and on the directional information. As an example, the spatial audio representation may represent a binaural audio representation or a multichannel audio representation.

Thus, the second aspect of the invention allows to determine a spatial audio representation based on the first and second signal representation and based on the directional information.

Furthermore, since the right signal representation is associated with the right audio signal and since the left signal representation is associated with the left audio signal, it is possible to generate or obtain a Left/Right-stereo representation of audio based on the left and right signal representation. Thus, although the right and left signal representation and the directional information may be used for determining a spatial audio representation, this representation comprising the left and right signal representation is completely backwards compatible, i.e. it is possible to generate or obtain a Left/Right-stereo representation of audio based on the left and right signal representation.

For instance, an optional decoding of an encoded representation may be performed, wherein this encoded representation may comprise an encoded left representation of the left signal representation and an encoded right representation for the right signal representation. Thus, a decoding process may be performed in order to obtain the left signal representation and the right signal representation from the encoded representation. Furthermore, as an example, the encoded representation may comprise an encoded directional information of the directional information. Then, the decoding process may also be used in order to obtain the directional information from the encoded representation.

For instance, an audio channel signal representation of the plurality of audio channel signal representations may be associated with at least one subband of the plurality of subbands. Thus, for instance, an audio channel signal representation of the plurality of audio channel signal representations may comprise a plurality of subband components, wherein each of the subband components is associated with a subband of the plurality of subbands. For instance, a frequency range in the frequency domain may be divided into the plurality of subbands. Nevertheless, the audio channel representation may be a representation in the time domain or a representation in the frequency domain.

According to an exemplary embodiment of all aspects of the invention, the directional information is indicative of the direction of the sound source relative to a first and a second microphone for a respective subband of the at least one subband of the plurality of subbands associated with the left and the right signal representation.

For instance, the audio representation comprises a plurality of audio channel signal representations, wherein at least one of the audio channel signal representation may for instance be associated with a channel of a spatial audio signal representation, and wherein the directional information is used to generate a audio channel signal representation of the at least one audio channel signal representation in accordance with the desired channel.

According to an exemplary embodiment of all aspects of the invention, the directional information comprises an angle representative of arriving sound relative to the first and second microphones for a respective subband of the at least one subband of the plurality of subbands associated with the left and right signal representation.

For instance, an audio channel signal representation of the plurality of audio channel signal representations may be associated with at least one subband of the plurality of subbands. Thus, for instance, an audio channel signal representation of the plurality of audio channel signal representations may comprise a plurality of subband components, wherein each of the subband components is associated with a subband of the plurality of subbands. For instance, a frequency range in the frequency domain may be divided into the plurality of subbands. Nevertheless, the audio channel representation may be a representation in the time domain or a representation in the frequency domain.

Then, as an example, at least one audio channel signal representation of the plurality of audio channel signal representation may be determined based on the left and right signal representation and at least partially based on the directional information, wherein subband components of the respective audio channel signal representations having dominant sound source directions may be emphasized relative to subbands components having less dominant sound source directions. Furthermore, for instance, an ambient signal representation may be generated based on the left and right channel representation in order to create a perception of an externalization for a sound image, wherein this ambient signal representation may be combined with the respective audio channel signal representation of the plurality of audio channel signal representations. Said combining may be performed in the time domain or in the frequency domain. Thus, the respective audio channel signal representation comprises or includes said ambient signal representation at least partially after this combining is performed. For instance, said combining may comprise adding the ambient signal representation to the respective audio channel signal representation.

According to an exemplary embodiment of the second aspect of the invention, the method comprises for each of at least one subband of the plurality of subbands associated with the left and right signal representation determining a time delay for the respective subband based on the directional information of this subband, the time delay being indicative of a time difference between the left signal representation and the right signal representation with respect to the sound source for the respective subband.

For instance, the directional information may comprise the time delay $\tau_b$ for the respective subband of at least one subband of the plurality of subbands. In this case, time delay $\tau_b$ for the respective subband can be directly obtained from the directional information.

If the time delay $\tau_b$ for the respective subband is not directly available from the directional information, the time delay $\tau_b$ may be calculated based on the directional information of the respective subband.

Furthermore, for instance, it may assumed without any limitation that the directional information may comprise the angle $\alpha_b$ representative of arriving sound relative to the first and second microphone for a respective subband b of the at least one subband of the plurality of subbands associated with the left and right signal representation. Then, if the directional information comprises an angle $\alpha_b$ representative of arriving sound relative to the first and second microphone for the respective subband b, the time delay $\tau_b$ may be calculated based on this angle $\alpha_b$. Furthermore, additional information on the arrangement of microphones in the predetermined geometric configuration may be used for calculating the time delay $\tau_b$. As an example, this additional information may be included in the directional information or it may be made available in different way, e.g. as a kind of a-prior information, e.g. by means of stored information of a decoder.

According to an exemplary embodiment of the second aspect of the invention, said determining a time delay for the respective subband comprises determining at least one of the following distances: a distance indicative of the distance between the first and second microphone, and a distance indicative of the distance between the sound source and a microphone of the first and second microphone.

For instance, the directional information may comprise at least one of the following distances: a distance indicative of the distance between the first and second microphone, and a distance indicative of the distance between the sound source and a microphone of the first and second microphone.

Thus, the additional information on the arrangement of the two or more microphones in the predetermined geometric configuration may comprise said at least one of the above mentioned distances.

For instance, based on the at least one determined time delay $\tau_b$ associated with the at least one subband of the plurality of subbands, a spatial audio signal representation may be determined.

According to an exemplary embodiment of the second aspect of the invention, said determining an audio signal representation comprises determining a first signal representation, wherein said determining of the first signal representation comprises for each of at least one subband of the plurality of subbands associated with the left and the right signal representation: determining a subband component of the first signal representation based on a sum of a respective subband component of one of the left and right signal representation shifted by a time delay and of a respective subband component of the other of the left and right signal representation, the time delay being indicative of a time difference between the left signal representation and the right signal representation with respect to the sound source for the respective subband.

For instance, the first signal representation $S_1(n)$ may be used as a basis for determining at least one audio channel signal representation of the plurality of audio channel signal representations. As an example, the plurality of audio channel signal representations may represent k audio channel signal representations $C_i(n)$, wherein $i \in \{1,K,k\}$ holds, and wherein $C_i^b(n)$ represents a bth subband component of the ith channel signal representation. Thus, an audio channel signal representation $C_i(n)$ may comprise a plurality of subband components $C_i^b(n)$, wherein each subband component $C_i^b(n)$ of the plurality of subband components may be associated with a respective subband b of the plurality of subbands.

As an example, subband components of an ith audio channel signal representation $C_i(n)$ having dominant sound source directions may be emphasized relative to subbands components of the ith audio channel signal representation $C_i(n)$ having less dominant sound source directions.

According to an exemplary embodiment of the second aspect of the invention, said determining an audio signal representation comprises determining a second signal representation, wherein said determining of the second signal representation comprises for each of at least one subband of the plurality of subbands associated with the left and the right signal representation: determining a subband component of the second signal representation based on a difference of a respective subband component of one of the left and right signal representation shifted by the respective time delay and of a respective subband component of the other of the left and right signal representation.

As an example, said second signal representation $S_2(n)$ may be considered to represent an ambient signal representation generated based on the left and right channel representation, wherein this second signal representation $S_2(n)$ may be used to create a perception of an externalization for a sound image. For instance, the ambient signal representation $S_2(n)$ may be combined with an audio channel signal representation $C_i(n)$ of the plurality of audio channel signal representations. Thus, the respective audio channel signal representation comprises or includes said ambient signal representation at least partially after this combining is performed. Said combining may be performed in the time domain or in the frequency domain. For instance, said combining may comprise adding the ambient signal representation to the respective audio channel signal representation.

For instance, if the audio representation represents a binaural audio representation, the first signal representation $S_1(n)$ may represent a mid signal representation including a sum of a shifted signal representation (a time-shifted one of the left and right signal representation) and a non-shifted signal (the other of the left and right signal representation), and the second signal representation $S_2(n)$ may represent a side signal including a difference between a time-shifted signal of one of the left and right signal representation) and a non-shifted signal (the other of the left and right signal representation).

According to an exemplary embodiment of the second aspect of the invention, said audio signal representation comprises a plurality of audio channel signal representations, wherein at least one audio channel signal representation of the plurality of audio channel signal representations is determined based on: the first signal representation being filtered by a filter function associated with the respective channel, wherein said filter function is configured to filter at least one subband component of the first signal representation based on the directional information.

According to an exemplary embodiment of the second aspect of the invention, the filter function associated with a respective channel is configured to apply at least one weighting factor to the first signal representation, wherein each of the at least one weighting factor is associated with a subband of the plurality of subbands.

According to an exemplary embodiment of the second aspect of the invention, the method comprising for at least one audio channel signal representation of the plurality of audio channel signal representations: combining the filtered signal representation with an ambient signal representation being determined based on the second signal representation being filtered by a second filter function associated with the respective channel.

According to an exemplary embodiment of the second aspect of the invention, performing a decorrelation on at least two audio channel representations of the plurality of audio channel representations.

As an example, before said combining is performed, a decorrelation may be performed on the ambient signal representation. As an example, this decorrelation may be performed in a different manner depending on the audio channel signal representation of the plurality of audio channel signal representations. Thus, for instance, the same ambient signal representation may be used as a basis to be combined with several audio channel signal representations, wherein different decorrelations are performed to the ambient signal representation in order to generate a plurality of different decorrelated ambient signal representations, wherein each of the plurality of different decorrelated ambient signal representation may be respectively combined with the respective audio channel signal representation of the several audio channel signal representations.

Or, for instance, a decorrelation may be performed after the combining.

According to a first exemplary embodiment of a third aspect of the invention, a method is disclosed, comprising providing an audio signal representation comprising a first signal representation and a second signal representation, each of the first and second signal representation being associated with a plurality of subbands of a frequency range, the first signal representation comprising a plurality of subband components, wherein each subband component of at least one subband component of the plurality of subband components of the first signal representation is determined based on a sum of a respective subband component of one of a left audio signal representation and a right audio signal representation shifted by a time delay and of a respective subband component of the other of the left and right audio signal representation, the left audio signal representation being associated with a left audio channel, the right audio signal representation being associated with a right audio channel, the time delay being indicative of a time difference between the left signal representation and the right signal representation with respect to a sound source for the respective subband, the second signal representation comprising a plurality of subband components, wherein each subband component of at least one subband component of the plurality of subband components of the second signal representation is determined based on a difference of a respective subband component of one of the left audio signal representation and the right audio signal representation shifted by the time delay and of a respective subband component of the other of the left and right audio signal representation, the method further comprising providing directional information associated with at least one subband of the plurality of subbands associated with the left and the right signal representation, the directional information being at least partially indicative of a direction of a sound source with respect to the left and right audio channel, and providing for at least one subband of the plurality of subbands an indicator being indicative that a respective subband component of the first and the second signal representation is determined based on combining a respective subband component of the left audio signal representation with a respective subband component of the right audio signal representation.

According to a second exemplary embodiment of the third aspect of the invention, an apparatus is disclosed, which is configured to perform the method according to the third aspect of the invention, or which comprises means for performing the method according to the first aspect of the invention, i.e. means for providing an audio signal representation comprising a first signal representation and a second signal representation, each of the first and second signal representation being associated with a plurality of subbands of a frequency range, the first signal representation comprising a plurality of subband components, wherein each subband component of at least one subband component of the plurality of subband components of the first signal representation is determined based on a sum of a respective subband component of one of a left audio signal representation and a right audio signal representation shifted by a time delay and of a respective subband component of the other of the left and right audio signal representation, the left audio signal representation being associated with a left audio channel, the right audio signal representation being associated with a right audio channel, the time delay being indicative of a time difference between the left signal representation and the right signal representation with respect to a sound source for the respective subband, the second signal representation comprising a plurality of subband components, wherein each subband component of at least one subband component of the plurality of subband components of the second signal representation is determined based on a difference of a respective subband component of one of the left audio signal representation and the right audio signal representation shifted by the time delay and of a respective subband component of the other of the left and right audio signal representation, means for providing directional information associated with at least one subband of the plurality of subbands associated with the left and the right signal representation, the directional information being at least partially indicative of a direction of a sound source with respect to the left and right audio channel, and means for providing for at least one subband of the plurality of subbands an indicator being indicative that a respective subband component of the first and the second signal representation is determined based on combining a respective subband component of the left audio signal representation with a respective subband component of the right audio signal representation.

According to a third exemplary embodiment of the third aspect of the invention, an apparatus is disclosed, comprising at least one processor and at least one memory including computer program code, the at least one memory and the computer program code configured to, with the at least one processor, cause the apparatus at least to perform the method according to the first aspect of the invention. The computer program code included in the memory may for instance at least partially represent software and/or firmware for the processor. Non-limiting examples of the memory are a Random-Access Memory (RAM) or a Read-Only Memory (ROM) that is accessible by the processor.

According to a fourth exemplary embodiment of the third aspect of the invention, a computer program is disclosed, comprising program code for performing the method according to the first aspect of the invention when the computer program is executed on a processor. The computer program may for instance be distributable via a network, such as for instance the Internet. The computer program may for instance be storable or encodable in a computer-readable medium. The computer program may for instance at least partially represent software and/or firmware of the processor.

According to a fifth exemplary embodiment of the third aspect of the invention, a computer-readable medium is disclosed, having a computer program according to the first aspect of the invention stored thereon. The computer-readable medium may for instance be embodied as an electric, magnetic, electro-magnetic, optic or other storage medium, and may either be a removable medium or a medium that is fixedly installed in an apparatus or device. Non-limiting examples of such a computer-readable medium are a RAM or ROM. The computer-readable medium may for instance be a tangible medium, for instance a tangible storage medium. A computer-readable medium is understood to be readable by a computer, such as for instance a processor.

The first signal representation and the second signal representation may be represented in a time domain or a frequency domain.

For instance, the first and/or the second signal representation may be transformed from a time domain to a frequency domain and vice versa. As an example, the frequency domain representation for the kth signal representation may be represented as $S_k(n)$, with $k\epsilon\{1,2\}$, and $n\epsilon\{0,1,K,N-1\}$, i.e., $S_1(n)$ may represent the first signal representation in the frequency domain and $S_2(n)$ may represent the second signal representation in the frequency domain. For instance, N may represent the total length of the window considering a sinusoidal window (length $N_s$) and the additional $D_{tot}$ zeros, as will be described in the sequel with respect to an exemplary transform from the time domain to the frequency domain.

Each of the first and second signal representation is associated with a plurality of subbands of a frequency range. For instance, a frequency range in the frequency domain may be divided into the plurality of subbands. The first signal representation comprises a plurality of subband components and the second signal representation comprises a plurality of subband components, wherein each of the plurality of subband components of the first signal representation is associated with a respective subband of the plurality of subbands and wherein each of the plurality of subband components of the second signal representation is associated with a respective subband of the plurality of subbands. Thus, the first signal representation may be described in the frequency domain as well as in the time domain by means the plurality of subband component, wherein the same holds for the second signal representation.

For instance, the subband components may be in the time-domain or in the frequency domain. In the sequel, it may be assumed without any limitation the subband components are in the frequency domain.

As an example, a subband component of a kth signal representation $S_k(n)$ may denoted as $S_k^b(n)$, wherein b may denote the respective subband. As an example, the kth signal representation in the frequency domain may be divided into B subbands $$S_k^b(n)=s_k(n_b+n),\ n=0,K\ n_{b+1}-n_b-1,\ b=0,K,B-1, \tag{11}$$

where $n_b$ is the first index of bth subband. The width of the subbands may follow, for instance, the equivalent rectangular bandwidth (ERB) scale.

Furthermore each subband component of at least one subband component of the plurality of subband components of the first signal representation is determined based on a sum of a respective subband component of one of a left audio signal representation and a right audio signal representation shifted by a time delay and of a respective subband component of the other of the left and right audio signal representation, wherein the left audio signal representation is associated with a left audio channel and the right audio signal representation is associated with a right audio channel, the time delay being indicative of a time difference between the left signal representation and the right signal representation with respect to a sound source for the respective subband.

The time-shifted representation of a kth signal representation $X_k^b(n)$ may be expressed as $$X_{k,\tau_b}^b(n) = X_k^b(n)e^{-j\frac{2\pi\tau_b}{N}}. \tag{12}$$

The left audio signal representation is associated with a left audio channel and the right signal representation is associated with a right audio channel, wherein each of the left and right audio signal representations are associated with a plurality of subbands of a frequency range. Thus, in a frequency domain the left signal representation and the right signal representation may each comprise a plurality of subband components, wherein each of the subband components is associated with a subband of the plurality of subbands. For instance, a frequency range in the frequency domain may be divided into the plurality of subbands. Nevertheless, the left and right signal representation may be a representation in the time domain or a representation in the frequency domain. For instance, similar to the notation of the first and the second signal representation, in the frequency domain the left signal representation may be denoted as $X_1(n)$ and the right signal representation may be denoted as $X_2(n)$, wherein a subband component of a the left signal representation may denoted as $X_1^b(n)$, wherein b may denote the respective subband, and wherein a subband component of a the left signal representation $X_2(n)$ may denoted as $X_2^b(n)$, wherein b may denote the respective subband. As an example, the left and right audio signal representation in the frequency domain may be each divided into B subbands as explained above with respect to the first and second signal representation, wherein k=1 or k=2 holds:

$$X_k^b(n)=x_k(n_b+n),\ n=0,K\ n_{b+1}-n_b-1,\ b=0,K,B-1, \tag{13}$$

For instance, the left audio channel may represent a signal captured by a first microphone and the second audio channel may represent a signal captured by a second microphone.

Furthermore, for instance, if the time delay $\tau_b$ for a respective subband b of the at least one subband of the plurality of subbands is not available, the time delay $\tau_b$ of this subband b may be determined based on the explanations presented with respect to the first or second aspect of the invention. For instance, a time delay $\tau_b$ maybe determined that provides a good or maximized similarity between the respective subband component of one of the left and right audio signal representation shifted by the time delay $\tau_4$ and the respective subband component of the other of the left or right signal representation. As an example, said similarity may represent a correlation or any other similarity measure.

For instance, for each subband of a subset of subbands of the plurality of subband or for each subband of the plurality of subbands a respective time delay $\tau_b$ may be determined.

As an example, the time shift $\tau_b$ may indicate how much closer the sound source is to the first microphone than the second microphone. With respect to exemplary predefined geometric constellation mentioned above, when $\tau_b$ is positive, the sound source is closer to the second microphone, and when $\tau_b$ is negative, the sound source is closer to the first microphone.

Furthermore, directional information associated with at least one subband of the plurality of subbands is provided. For instance, the directional information is at least partially indicative of a direction of a sound source with respect to the left and right audio channel, the left audio channel being associated with the left audio signal representation and the right audio channel being associated with the right audio signal representation. For instance, the at least one subband of the plurality of subbands may represent a subset of subbands of the plurality of subbands or may represent the plurality of subbands associated with the left and the right signal representation. The directional information may represent any directional information mentioned with respect to the first and second aspect of the invention.

For instance, the directional information may be indicative of the direction of a dominant sound source relative to a first and a second microphone for a respective subband of the at least one subband of the plurality of subbands.

The directional information may comprise an angle $\alpha_b$ representative of arriving sound relative to the first microphone and second microphone for a respective subband b of the at least one subband of the plurality of subbands associated with the left and right audio signal representation. For instance, the angle $\alpha_b$ may represent the incoming angle $\alpha_b$ with respect to one microphone of the two or more microphones, but due to the predetermined geometric configuration of the at least two microphone, this incoming angel $\alpha_b$ can be considered to represent an angle $\alpha_b$ indicative of the sound source relative to the first and second microphone for a respective subband b.

As an example, the directional information may be determined by means of a directional analysis based on the left and right audio signal representation. For instance, any of the directional analysis described above may be used for determining the directional information.

Furthermore, for at least one subband of the plurality of subbands it is provided an indicator being indicative that a respective subband component of the first and second signal representation is determined based on combining a respective subband component of the left audio signal representation with a respective subband component of the right audio signal representation.

For instance, said combining may comprise adding or subtracting, as mentioned above with respect to determining the subband components of the first and second signal representation.

As an example, an indicator may be provided being indicative that a subband component $S_1^b(n)$ of the first signal representation $S_1(n)$ and the respective subband component $S_2^b(n)$ of the first signal representation $S_2(n)$, i.e., both subband components $S_1^b(n)$ and $S_2^b(n)$ are associated with the same subband b, is determined based on combining a respective subband component $X_1^b(n)$ of the left audio signal representation with a respective subband component $X_2^b(n)$ of the right audio signal representation. It has to be understood that one of the respective subband components $X_1^b(n)$ and $X_2^b(n)$ of the left and right audio signal representation may be time-shifted.

For instance, said indicator may be provided for each subband of a subset of subband of the plurality of subbands or for each subband of the plurality of subbands. Furthermore, as an example, a single one indicator may be provided indicating that the combining is performed for each subband.

As an example, said indicator may represent a flag indicating that a coding based on combining is applied. For instance, said coding may represent a Mid/Side-Coding, wherein the first signal representation may be considered as a mid signal representation and the second signal representation may be considered as a side signal representation.

A decoded left audio signal representation $D_1(n)$ and a decoded right audio signal representation $D_2(n)$ can be determined in an easy way be means of performing the following equations for at least one subband of the plurality of subbands:

$$D_1^b(n)=A_1^b(n)+A_2^b(n), \tag{14}$$

$$D_2^b(n)=A_1^b(n)-A_2^b(n) \tag{15}$$

It has to be noted that each subband component $D_1^b(n)$ and $D_2^b(n)$ might be weighted with any factor, i.e. $D_1^b(n)$ and $D_2^b(n)$ might be multiplied with a factor f. For instance, f might be f=0.5, or f might be any other value.

For instance, this decoding may be assumed to represent a decoding in accordance with a first audio codec based on combing, which may represent a Mid/Side Decoding.

Furthermore, an encoded audio representation may be provided comprising the first and second signal representation, the directional information and the at least one indicator.

For instance, as will be explained in detail in the detailed description of embodiments of the invention, the encoded audio signal representation in accordance with the third aspect of the invention can be used for playing back the left and right channel by means of an audio decoder which is capable to decode in accordance with the first audio codec, wherein the indicator may cause the encoder to decode the respective at least one subband associated with the indicator based on equations (14) and (15) in order to obtain the left and right audio channel representations. Thus, encoded audio representation is completely backward compatible and might be played back by means of a standard decoder.

According to an exemplary embodiment of the third aspect of the invention, the first and second signal representation is fed as a first and a second input signal representation to an encoder, wherein the encoder is configured to determine a first encoded audio signal representation and a second encoded audio signal representation based on the first and second input signal representation, wherein in accordance with a first audio codec the encoder is basically configured to encode at least one subband component of the first input signal representation the respective at least one subband component of the second input signal in accordance with a first audio codec based on combining a subband component of the at least one subband component of the first input signal representation with the respective subband component of the at least one subband component of the second input signal representation in order to determine a respective subband component of the first encoded audio signal and a respective subband component of the second encoded audio signal and to provide for at least one subband of the plurality of subbands associated with the at least one subband component of the first input signal representation and with the at least one subband component of the second input signal representation an audio codec indicator being indicative that the first audio coded is used for encoding this at least one subband of the plurality of subbands, wherein the method comprises selecting the first audio codec of the encoder, bypassing the combining associated with the first audio codec in the encoder such that the first encoded audio signal representation represents the first audio representation and that the second encoded audio signal representation represents the second audio representation, wherein the audio codec indicator provided for the at least one subband of the plurality of subbands represents the indicator being indicative that a respective subband of the first and second signal representation is determined based on combining a respective subband component of the left audio signal representation with a respective subband component of the right audio signal representation.

For instance, under the non-limiting assumption that $I_1(n)$ may represent the first input signal representation in the frequency domain and $I_1^b(n)$ represents a bth subband component of the first input signal representation 911 associated with subband b of the plurality of subbands, and under the non-limiting assumption that $I_2(n)$ may represent the second input signal representation 912 in the frequency domain and $I_2^b(n)$ represents a bth subband component of the second input signal representation 912 associated with subband b of the plurality of subbands, the first audio coded may be applied to at least one subband of the plurality of subband, wherein for each subband of at least one subband of the plurality of subbands the encoder is configured to determine a respective subband component $A_1^b(n)$ of the first encoded audio representation $A_1(n)$ based on combining the respective subband component $I_1^b(n)$ of the first input signal representation $I_1(n)$ with the respective subband component component $I_2^b(n)$ the second input signal representation $I_2(n)$, to determine a respective subband component $A_2^b(n)$ of the second encoded audio representation $A_2(n)$ based on combining the respective subband component $I_1^b(n)$ of the first input signal representation $I_1(n)$ with the respective subband component component $I_2^b(n)$ the second input signal representation $I_2(n)$, and, optionally, to provide an audio codec indicator being indicative that the respective subband is encoded in accordance with the first audio codec.

For instance, said combining in accordance with the first audio codec may include determining a subband component $A_1^b(n)$ of the first encoded audio representation $A_1(n)$ based an a sum of the respective subband component $I_1^b(n)$ of the first input signal representation $I_1(n)$ and the respective subband component component $I_2^b(n)$ the second input signal representation $I_2(n)$. For instance, said sum may be determined as follows:

$$A_1^b(n)=I_1^b(n)+I_2^b(n) \tag{16}$$

It has to be noted that the determined subband component $A_1^b(n)$ may be weighted with any factor, i.e. $A_1^b(n)$ might be multiplied with a factor w. For instance, w might be f=0.5, or w might be any other value.

For instance, said combining in accordance with the first audio codec may include determining a subband component $A_2^b(n)$ of the first encoded audio representation $A_2(n)$ based an a difference of the respective subband component $I_1^b(n)$ of the first input signal representation $I_1(n)$ and the respective subband component component $I_2^b(n)$ the second input signal representation $I_2(n)$. For instance, said difference may be determined as follows:

$$A_1^b(n)=I_1^b(n)-I_2^b(n) \tag{17}$$

It has to be noted that determined subband component $A_1^b(n)$ may be weighted with any factor, i.e. $A_1^b(n)$ might be multiplied with a factor w. For instance, w might be f=0.5, or w might be any other value.

As an example, the audio encoder may be basically configured to select for each subband of at least one subband of the plurality of subbands whether to perform audio encoding of the respective subband component of the first input signal representation and the respective subband component of the second input signal representation in accordance with the first audio codec or in accordance with a further audio codec, wherein the further audio codec represents an audio codec being different from the first audio codec. Furthermore, the audio indicator may be configured to identify for each subband of the at least one subband of the plurality of subbands which audio coded is chosen for the respective subband.

The first signal representation and the second signal representation may be fed to the audio encoder and the first audio codec is selected at the audio encoder. Said selection may comprise selecting the first audio coded for at least one subband of the plurality of subbands, e.g. for a subset of subbands of the plurality of subbands or for each subband of the plurality of subbands.

Furthermore, the method comprises bypassing the combining associated with the first audio codec such that the first encoded audio representation $A_1(n)$ represents the first signal representation $S_1(n)$ and that the second encoded audio representation $A_2(n)$ represents the second signal representation.

Thus, for instance, the determining of the first and second encoded audio representations $A_1(n)$, $A_2(n)$ in audio encoder is bypassed by feeding the first signal representation $S_1(n)$ to the output of the audio encoder in such a way that the first encoded audio representation $A_1(n)$ represents the first signal representation $S_1(n)$ and by feeding the second signal representation $S_2(n)$ to the output of the audio encoder in such a way that the second encoded audio representation $A_2(n)$ represents the second signal representation $S_2(n)$.

Since the first audio codec is selected in, the audio encoder outputs an audio codec indicator being indicative that the at least one subband of the plurality of subbands is encoded in accordance with the first audio codec, wherein the at least one subband may for instance be a subset of subbands of the plurality of subbands or all subbands of the plurality of subbands.

This audio codec indicator provided for the at least one subband of the plurality of subbands is used as said indicator being indicative that a respective subband of the first and second signal representation is determined based on combining a respective subband component of the left audio signal representation with a respective subband component of the right audio signal representation.

Furthermore, the first encoded audio representation $A_1(n)$ represents the first signal representation and the second encoded audio representation $A_2(n)$ represents the second signal representation.

According to an exemplary embodiment of the third aspect of the invention, the encoder is basically configured to select for each subband of at least one subband of the plurality of subbands whether to perform audio encoding of the respective subband component of the first input signal representation and the respective subband component of the second input signal representation in accordance with the first audio codec or in accordance with a further audio codec.

According to an exemplary embodiment of the third aspect of the invention, said left audio channel is captured by a first microphone and said right audio channel is captured by a second microphone of two or more microphones arranged in a predetermined geometric configuration.

According to an exemplary embodiment of the third aspect of the invention, the directional information is indicative of the direction of the sound source relative to the first and second microphone for a respective subband of the at least one subband of the plurality of subbands associated with the left and the right signal representation.

The example embodiments of the method, apparatus, computer program and system according to the invention presented above and their single features shall be understood to be disclosed also in all possible combinations with each other.

Further, it is to be understood that the presentation of the invention in this section is based on example non-limiting embodiments.

Other features of the invention will be apparent from and elucidated with reference to the detailed description presented hereinafter in conjunction with the accompanying drawings. It is to be understood, however, that the drawings are designed solely for purposes of illustration and not as a definition of the limits of the invention, for which reference should be made to the appended claims. It should further be understood that the drawings are not drawn to scale and that they are merely intended to conceptually illustrate the structures and procedures described therein. In particular, presence of features in the drawings should not be considered to render these features mandatory for the invention.

DETAILED DESCRIPTION OF EMBODIMENTS OF THE INVENTION

Figure 1A:
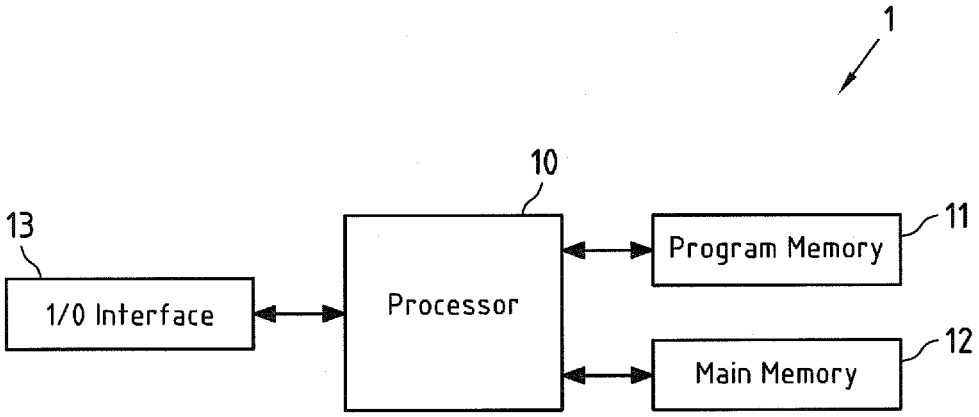
FIG. 1*a*: a schematic block diagram of an example embodiment of an apparatus according to any aspect of the invention.

FIG. 1*a* schematically illustrates components of an apparatus 1 according to an embodiment of the invention. Apparatus 1 may for instance be an electronic device that is for instance capable of encoding at least one of speech, audio and video signals, or a component of such a device. For instance, apparatus 1 may be or may form a part of a terminal.

Apparatus 1 may for instance be configured to provide a left signal representation associated with a left audio channel and a right signal representation associated with a right audio signal, each of the left and right signal representations being associated with a plurality of subbands of a frequency range, and to provide a directional information associated with at least one subband of the plurality of subbands associated with a plurality of subbands of a frequency range, in accordance with the first aspect of the invention.

Alternatively, apparatus 1 may for instance be configured to determine an audio signal representation based on a left signal representation, on a right signal representation and on directional information, wherein each of the left and right signal representations being associated with a plurality of subbands of a frequency range, and wherein the directional information is associated with at least one subband of the plurality of subbands associated with the left and the right signal representation, the directional information being indicative of a direction of a sound source with respect to the left and right audio channel, in accordance with the second aspect of the invention Or, alternatively, apparatus 1 may for instance be configured to provide an audio signal representation comprising a first signal representation and a second signal representation, each of the first and second signal representation being associated with a plurality of subbands of a frequency range, the first signal representation comprising a plurality of subband components, wherein each subband component of at least one subband component of the plurality of subband components of the first signal representation is determined based on a sum of a respective subband component of one of a left audio signal representation and a right audio signal representation shifted by a time delay and of a respective subband component of the other of the left and right audio signal representation, the left audio signal representation being associated with a left audio channel, the right audio signal representation being associated with a right audio channel, the time delay being indicative of a time difference between the left signal representation and the right signal representation with respect to a sound source for the respective subband, the second signal representation comprising a plurality of subband components, wherein each subband component of at least one subband component of the plurality of subband components of the second signal representation is determined based on a difference of a respective subband component of one of the left audio signal representation and the right audio signal representation shifted by the time delay and of a respective subband component of the other of the left and right audio signal representation, to provide directional information associated with at least one subband of the plurality of subbands associated with the left and the right signal representation, the directional information being at least partially indicative of a direction of a sound source with respect to the left and right audio channel, and to provide for at least one subband of the plurality of subbands an indicator being indicative that a respective subband component of the first and the second signal representation is determined based on combining a respective subband component of the left audio signal representation with a respective subband component of the right audio signal representation, in accordance with a third aspect of the invention.

Apparatus 1 may for instance be embodied as a module. Non-limiting examples of apparatus 1 are a mobile phone, a personal digital assistant, a portable multimedia (audio and/or video) player, and a computer (e.g. a laptop or desktop computer).

Apparatus 1 comprises a processor 10, which may for instance be embodied as a microprocessor, Digital Signal Processor (DSP) or Application Specific Integrated Circuit (ASIC), to name but a few non-limiting examples. Processor 10 executes a program code stored in program memory 11, and uses main memory 12 as a working memory, for instance to at least temporarily store intermediate results, but also to store for instance pre-defined and/or pre-computed databases. Some or all of memories 11 and 12 may also be included into processor 10. Memories 11 and/or 12 may for instance be embodied as Read-Only Memory (ROM), Random Access Memory (RAM), to name but a few non-limiting examples. One of or both of memories 11 and 12 may be fixedly connected to processor 10 or removable from processor 10, for instance in the form of a memory card or stick.

Processor 10 further controls an input/output (I/O) interface 13, via which processor receives or provides information to other functional units.

As will be described below, processor 10 is at least capable to execute program code for providing a left and a right signal representation and directional information. However, processor 10 may of course possess further capabilities. For instance, processor 10 may be capable of at least one of speech, audio and video encoding, for instance based on sampled input values. Processor 10 may additionally or alternatively be capable of controlling operation of a portable communication and/or multimedia device.

Apparatus 1 of FIG. 1*a* may further comprise components such as a user interface, for instance to allow a user of apparatus 1 to interact with processor 10, or an antenna with associated radio frequency (RF) circuitry to enable apparatus 1 to perform wireless communication.

The circuitry formed by the components of apparatus 1 may be implemented in hardware alone, partially in hardware and in software, or in software only, as further described at the end of this specification.

Figure 1B:
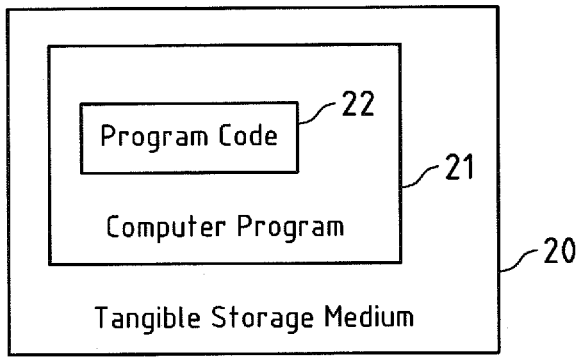
FIG. 1*b*: a schematic illustration of an example embodiment of a tangible storage medium according to any aspect of the invention.

FIG. 1*b* is a schematic illustration of an embodiment of a tangible storage medium 20 according to the invention. This tangible storage medium 20, which may in particular be a non-transitory storage medium, comprises a program 21, which in turn comprises program code 22 (for instance a set of instructions). Realizations of tangible storage medium 20 may for instance be program memory 12 of FIG. 1*a*. Consequently, program code 22 may for instance implement the flowcharts of FIGS. 2*a*, 3, 3*b*, 5, 6*a*, 6*b*, 7, 8, and 9*b* associated with one aspect of the first, second and third aspect of the invention discussed below.

Figure 2A:
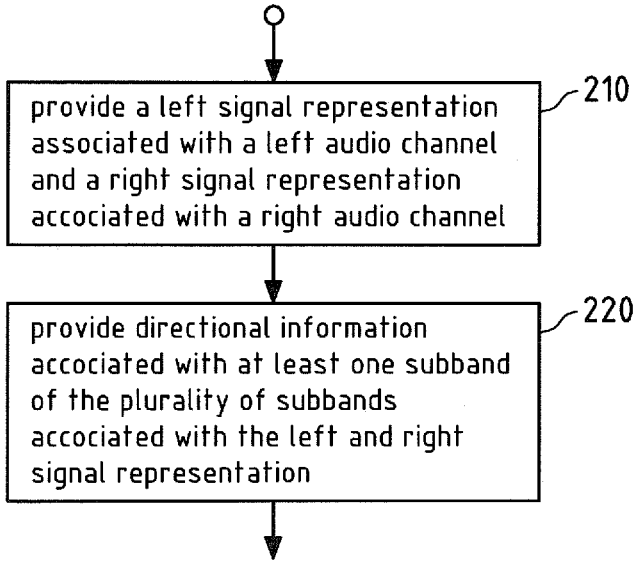
FIG. 2*a*: a flowchart of a first example embodiment of a method according to a first aspect of the invention.

FIG. 2*a* shows a flowchart 200 of a method according to a first embodiment of a first aspect of the invention. The steps of this flowchart 200 may for instance be defined by respective program code 32 of a computer program 31 that is stored on a tangible storage medium 30, as shown in FIG.

1*b*. Tangible storage medium 30 may for instance embody program memory 11 of FIG. 1*a*, and the computer program 31 may then be executed by processor 10 of FIG. 1*a*.

In step 210, a left signal representation associated with a left audio channel and a right signal representation associated with a right audio channel is provided, wherein each of the left and right signal representations are associated with a plurality of subbands of a frequency range. Thus, in a frequency domain the left signal representation and the right signal representation may each comprise a plurality of subband components, wherein each of the subband components is associated with a subband of the plurality of subbands. For instance, a frequency range in the frequency domain may be divided into the plurality of subbands. Nevertheless, the left and right signal representation may be a representation in the time domain or a representation in the frequency domain.

For instance, the left audio channel may represent a signal captured by a first microphone and the second audio channel may represent a signal captured by a second microphone.

Furthermore, in step 220, directional information associated with at least one subband of the plurality of subbands associated with the left and the right signal representation is provided, the directional information being at least partially indicative of a direction of a sound source with respect to the left and right audio channel. For instance, the at least one subband of the plurality of subbands may represent a subset of subbands of the plurality of subbands or may represent the plurality of subbands associated with the left and the right signal representation.

The directional information associated with the at least one subband may represent any information which can be used to generate a spatial audio signal subband representation associated with a subband of the at least one subband based on the left signal representation, on the right signal representation, and on the directional information associated with the respective subband.

For instance, the directional information may be indicative of the direction of a dominant sound source relative to the first and second microphone for a respective subband of the at least one subband of the plurality of subbands.

Furthermore, the method according to a first embodiment of the first aspect of the invention may comprise determining an encoded representation (not depicted in FIG. 2*a*) of the left signal representation, of the right signal representation, and of the directional information. Thus, the encoded representation may comprise an encoded left signal representation of the left signal representation, an encoded right signal representation of the right signal representation, and an encoded directional information of the direction information.

Thus, as an example, the encoded representation may be transmitted via a channel to a corresponding decoder, wherein the decoder may be configured to decode the encoded representation and to determine a spatial audio signal representation based on the encoded representation, i.e. based on the left and right signal representation and based on the directional information. For instance, exemplary embodiments of such a decoder will be explained with respect to the second aspect of the invention.

Furthermore, since the right signal representation is associated with the right audio signal and since the left signal representation is associated with the left audio signal, it is possible to generate or obtain a Left/Right-stereo representation of audio based on the left and right signal representation. Thus, although the encoded representation may be used for determining a spatial audio representation, this encoded representation is completely backwards compatible, i.e. it is possible to generate or obtain a Left/Right-stereo representation of audio based on the encoded representation.

Figure 2B:
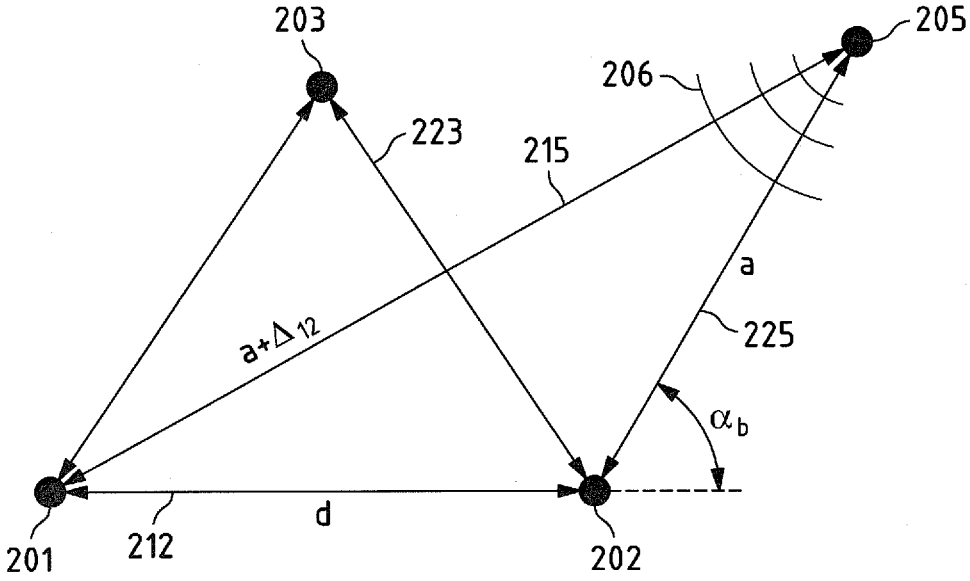
FIG. 2*b*: an illustration of an example of a microphone arrangement.

FIG. 2*b* depicts an illustration of an example of a microphone arrangement which might for instance be used for capturing the left and right audio channel used by the method according to a first embodiment depicted in FIG. 2*a*. As an example, this microphone arrangement may be used for any method explained in the sequel with respect to any aspect of the invention.

For instance, a sound source 205 may emit sound waves 206. It has to be understood, that this sound source 205 may represent a dominant sound source representation, wherein this dominant sound source representation may comprise several sound sources.

A first microphone 201 is configured to capture a first audio signal. For instance, with respect to the exemplary arrangement depicted in FIG. 2*b*, the first microphone 201 may be configured to capture the left audio channel. Furthermore, a second microphone 202 is configured to capture a second audio signal. For instance, with respect to the exemplary arrangement depicted in FIG. 2*b*, the second microphone may be configured to capture the right audio channel. The first microphone 201 and the second microphone 202 are positioned at different locations.

For instance, the first microphone 201 and the second microphone 202 may represent two microphones 201, 202 of two or more microphones, wherein said two or more microphones are arranged in a predetermined geometric configuration. As an example, the two or more microphones may represent ommnidirectional microphones, i.e. the two or more microphones are configured to capture sound events from all directions, but any other type of well suited microphones may be used as well.

The example of a microphone arrangement depicted in FIG. 2 comprises an optional third microphone 203 which is configured to capture a third audio signal.

In the exemplary arrangement, the two or more microphones 201, 202, 203 are arranged in a predetermined geometric configuration having an exemplary shape of a triangle with vertices separated by distance d, as depicted in FIG. 2*b*, wherein microphones 201, 202 and 203 are arranged on a plane in accordance with the geometric configuration. It has to be understood that the arrangement of microphones 201, 202, 203 depicted in FIG. 2*b* represents an example of a geometric configuration and different microphone setups and geometric configuration may be used. For instance, the optional third microphone 203 may be used to obtain further information regarding the direction of the sound source 205 with respect to the two or more microphones 201, 202, 203 arranged in a predetermined geometric configuration.

For instance, the directional information provided in step 220 of the method depicted in FIG. 2*a* may comprise an angle $\alpha_b$ representative of arriving sound relative to the first microphone 201 and second microphone 202 for a respective subband b of the at least one subband of the plurality of subbands associated with the left and right signal representation. As exemplarily depicted in FIG. 2*b*, the angle $\alpha_b$ may represent the incoming angle $\alpha_b$ with respect to one microphone 202 of the two or more microphones 201, 202, 203, but due to the predetermined geometric configuration of the at least two microphone 201, 202, 203, this incoming angel $\alpha_b$ can be considered to represent an angle $\alpha_b$ indicative of the sound source 205 relative to the first and second microphone for a respective subband b.

As an example, the directional information may be determined by means of a directional analysis based on the left and right signal representation.

Figure 3A:
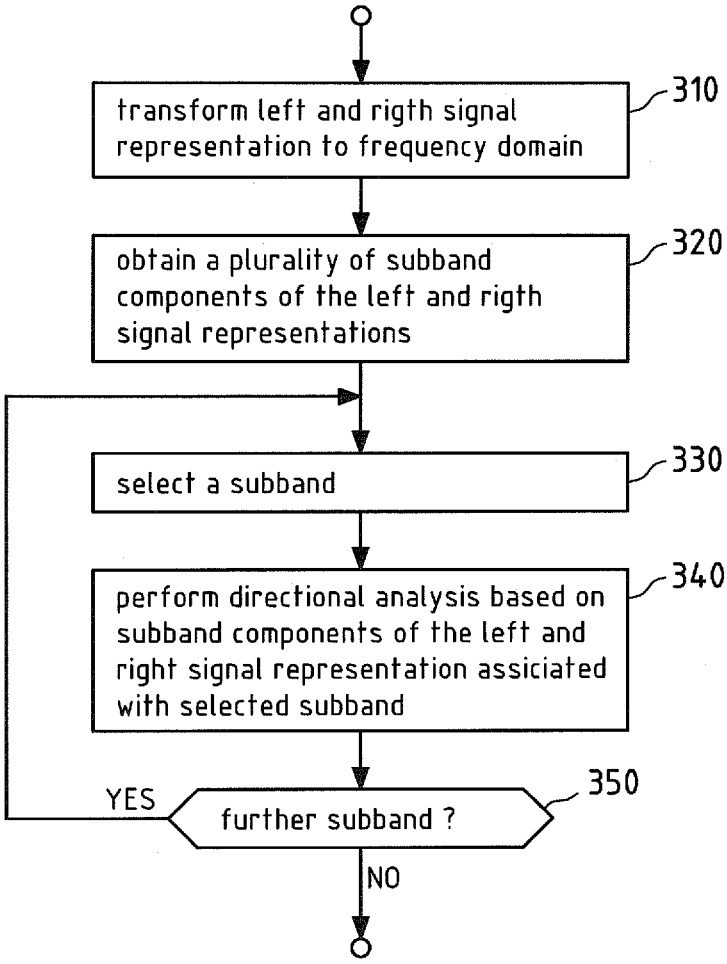
FIG. 3*a*: a flowchart of a second example embodiment of a method according to the first aspect the invention.

FIG. 3*a* depicts a flowchart of a second example embodiment of a method according to the first aspect of the invention which may be used for performing a directional analysis in order to at least partially determine the directional information.

In optional step 310, the left signal representation and right signal representation are transformed to the frequency domain. This step 310 may be omitted if the left and right signal representations represent signal representations in the frequency domain.

For instance, a Discrete Fourier Transform (DFT) may be applied in step 310 in order to obtain the left and right signal representation in the frequency domain. Furthermore, if the two or more microphones 201, 202, 203 represent more than the first and the second microphone 201, 202, the signals captured from the other microphones 203 may also be transformed to the frequency domain in step 310.

As an example, every input channel k may correspond to one of the two or more microphones 201, 202, 203 and may represent a digital version (e.g. sampled version) of the analog signal of the respective microphone 201, 202, 203. For instance, sinusoidal windows with 50 percent overlap and effective length of 20 ms (milliseconds) may be used, but any other percentage of overlap (if overlap is applied) and any other effective length may be used.

Furthers lore, as a non-limiting example, before the transform into the frequency domain is performed, $D_{tot}=D_{max}+D_{HRTF}$ zeroes may be added to the end of the window, wherein $D_{max}$ may correspond to the maximum delay in samples between the microphones. For instance, with respect to the geometrical configuration of the two or more microphones depicted in FIG. 1, the maximum delay is obtained as $$D_{max} = \frac{dF_s}{v}, \tag{18}$$

where $F_s$ is the sampling rate of the signal and v is the speed of sound in air. Optional term $D_{HRTF}$ may represent the maximum delay caused to the signal by further signal processing, e.g. caused by head related transfer functions (HRTF) processing.

After the transform to the frequency domain, the frequency domain representation for a kth signal representation may be represented as $X_k(n)$, with $k\epsilon\{1,2,K,l\}$, $l\geq 2$, and $n\epsilon\{0,1,K,N-1\}$. l represents the numbers of signals to be transformed to frequency domain, wherein $X_1(n)$ may represent the left signal representation transformed to frequency domain, $X_2(n)$ may represent the right signal representation transformed to the frequency domain, and, for the example presented with respect to FIG. 2*b*, $X_3(n)$ may represent the optional signal representation of the channel captured by the third microphone. N may represent the total length of the window considering the sinusoidal window (length $N_s$) and the additional $D_{tot}$ zeros.

In step 320, a plurality of subband components of the left signal representation and of the right signal representation are obtained. For instance, the subband components may be in the time-domain or in the frequency domain. In the sequel, it may be assumed without any limitation the subband components are in the frequency domain.

For instance, a subband component of a kth signal representation may denoted as $X_k^b(n)$. As an example, the kth signal representation in the frequency domain may be divided into B subbands $$X_k^b(n)=x_k(n_b+n),\ n=0,K\ n_{b+1}-n_b-1,\ b=0,K,B-1, \tag{19}$$

where $n_b$ is the first index of bth subband. The width of the subbands may follow, for instance, the equivalent rectangular bandwidth (ERB) scale.

The directional analysis is performed on at least one subband of the plurality of subbands. In step 330, one subband of the at least one subband of the plurality of subbands is selected.

In step 340, the directional analysis is performed based on the subband components of the left signal representation $X_1^b(n)$ and based on the subband components of the right signal representation $X_2^b(n)$. Furthermore, for instance, the directional analysis may be performed on the subband components of at least one further signal representation, e.g. $X_3^b(n)$, and/or on further additional information, e.g. additional information on the geometric configuration of the two or more microphones 201, 202, 203 and/or the sound source.

For instance, the directional analysis may determine a direction, e.g. the above-mentioned angel $\alpha_b$, of the (e.g., dominant) sound source 205. An example of such a directional analysis will be presented with respect to the third example embodiment of a method according to the invention depicted in FIG. 3*a*.

In step 350 it is checked whether there is a further subband of the at least one subband of the plurality of subbands, and if there is a further subband, the method proceeds with selecting one of the further subband in step 330.

Thus, the directional information can be determined for each subband of the at least one subband of the plurality of subbands based on the method depicted in FIG. 3*a*.

Figure 3B:
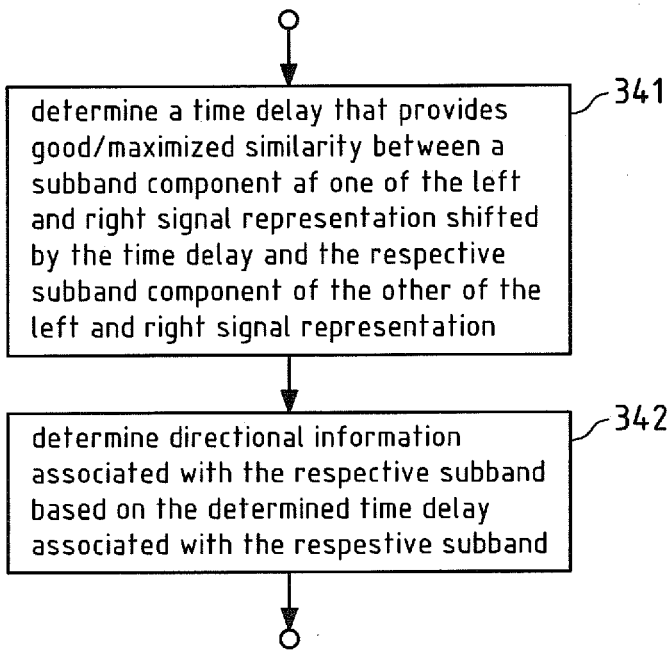
FIG. 3*b*: a flowchart of a third example embodiment of a method according to the first aspect of invention.

FIG. 3*b* depicts a flowchart of a third example embodiment of a method according to the invention, which may be used to determine direction information with a subband of the at least one subband of the plurality of subbands. For instance, the method depicted in FIG. 3*b* could be used for performing the directional analysis of step 340 of the second example embodiment of a method according to the invention depicted in FIG. 3*a*, wherein the direction information is determined for the subband selected in step 330, wherein this subband represent the respective subband.

In step 341 a time delay that provides a good or maximized similarity between the respective subband component of one of the left and right signal representation shifted by the time delay and the respective subband component of the other of the left or right signal representation is determined.

As an example, said similarity may represent a correlation or any other similarity measure.

For instance, this time delay may be assumed to represent a time difference between the frequency-domain representations of the left and right signal representations in the respective subband.

Thus, for instance, in step 341 it may be the task to find a time delay $\tau_b$ that provides a good or maximized similarity between the time-shifted left signal representation $X_{1,\tau_b}^b(n)$ and the right signal representation $X_2^b(n)$, or, to find a time delay $\tau_b$ that provides a good or maximized correlation between the time-shifted right signal representation $X_{2,\tau_b}^b(n)$ and the right signal representation $X_1^b(n)$. The time-shifted representation of a kth signal representation $X_k^b(n)$ may be expressed as $$X_{k,\tau_b}^b(n) = X_k^b(n)e^{-j\frac{2\pi\tau_b}{N}}. \tag{20}$$

As a non-limiting example, the time delay $\tau_b$ may be obtained by using a maximization function that maximises the correlation between $X_{1,\tau_n}^b(n)$ and $X_2^b(n)$:

$$\max_{\tau_b}\mathrm{Re}\left(\sum_{n=0}^{n_{b+1}-n_b-1} X_{1,\tau_b}^b(n) * X_2^b(n)\right), \tau_b \in [-D_{max}, D_{max}], \tag{21}$$

where Re indicates the real part of the result and * denotes complex conjugate. $X_1^b(n)$ and $X_2^b(n)$ may be considered to represent vector with length of $n_{b+1}-n_{b-1}$ samples. Also other perceptually motivated similarity measures than correlation may be used. Thus, step 341 could be considered to determine a time delay that provides a good or maximised similarity between a subband component of one of the left and right signal representation shifted by the time delay $\tau_b$ and the respective subband component of the other of the left or right signal representation.

Then, in step 342 directional information associated with the respective subband b is determined based on the determined time delay $\tau_b$ associated with the respective subband b.

The shift $\tau_b$ may indicate how much closer the sound source 215 is to the first microphone 201 than the second microphone 202. With respect to exemplary predefined geometric constellation depicted in FIG. 2*b*, when $\tau_b$ is positive, the sound source 205 is closer to the second microphone 202, and when $\tau_b$ is negative, the sound source 205 is closer to the first microphone 201. The actual difference in distance $\Delta_{12,b}$ might be calculated as $$\Delta_{12,b} = \frac{v\tau_b}{F_s}. \tag{22}$$

For instance, the angle $\alpha_b$ may be determined based on the predefined geometric constellation and the actual difference in distance $\Delta_{12,b}$.

As an example, with respect to predefined geometric constellation depicted in FIG. 2*b*, the distance 255 between the second microphone 202 and the sound source 205 may be a and the distance between the first microphone represents $a+\Delta_{12,b}$, wherein the angle $\hat{\alpha}_b$ may for instance be determined based on the following equation:

$$\hat{\alpha}_b = \pm\cos^{-1}\left(\frac{\Delta_{12,b}^2 + 2a\Delta_{12,b} - d^2}{2ad}\right), \tag{23}$$

where d is the distance between the first and second microphone 201, 202 and a may be the estimated distance between the dominant sound source 205 and the nearest microphone. For instance, with respect to equation (23) there are two alternatives for the direction of the arriving sound as the exact direction cannot be determined with only two microphones 201, 202. Thus, further information may be used to determine the correct direction $\alpha_b$.

For instance, the signal captured by the third microphone 203 may be used to determine the correct direction based on the two possible directions obtained by equation (23), wherein the third signal representation $X_3^b(n)$ is associated with the signal captured by the third microphone 203.

An example technique to define which of the signs in equation (23) is correct may be as follows:

For instance, the distances between the first microphone 201 and the two possible estimated sound sources can be expressed, under the assumption of a predetermined geometric configuration having an exemplary shape of a triangle with vertices separated by distance d, as $$\delta_b^+ = \sqrt{(h + a\sin(\hat{\alpha}_b))^2 + \left(\frac{d}{2} + \cos a\cos(\hat{\alpha}_b)\right)^2} \text{ and} \tag{24}$$

$$\delta_b^- = \sqrt{(h - a\sin(\hat{\alpha}_b))^2 + \left(\frac{d}{2} + \cos a\cos(\hat{\alpha}_b)\right)^2},$$

wherein h is the height of the equilateral triangle, i.e.

$$h = \frac{\sqrt{2}}{2}d. \tag{25}$$

The distances in equation (xx) equal to delays (in samples)

$$\tau_b^+ = \frac{\delta^+ - a}{v}F_s, \tag{26}$$

$$\tau_b^- = \frac{\delta^- - a}{v}F_s.$$

For instance, out of these two delays, the one may be selected that provides better correlation or a better similarity between the signal component $X_3^b(n)$ of the respective subband b of the third signal representation and a signal representation being representative or proportional to the signal received at the microphone nearest to the sound source 205 out of the first and second microphone 201, 201.

For instance, this signal representation being representative or proportional to the signal received at the microphone nearest to the sound source 205 out of the first and second microphone 201, 201 may be denoted as $X_{near}^b(n)$ and may be one of the following:

$$X_{near}^b(n) = \begin{cases} X_1^b(n), & \tau_b \le 0 \\ X_{1,-\tau_b}^b(n), & \tau_b \ge 0 \end{cases}, \tag{27}$$

$$X_{near}^b(n) = \begin{cases} X_{2,\tau_b}^b(n), & \tau_b \le 0 \\ X_2^b(n), & \tau_b \ge 0 \end{cases}, \text{ and}$$

$$X_{near}^b(n) = \begin{cases} \dfrac{X_1^b(n) + X_{2,\tau_b}^b(n)}{2}, & \tau_b \le 0 \\ \dfrac{X_{1,-\tau_b}^b(n) + X_2^b(n)}{2}, & \tau_b \ge 0 \end{cases}.$$

Then, for instance, the correlation (or any similarity measure) may be obtained as $$C_b^+ = \mathrm{Re}\left(\sum_{n=0}^{n_{b+1}-n_b-1} X_{near,\tau_b}^b(n) * X_3^b(n)\right), \quad (28)$$

$$C_b^- = \mathrm{Re}\left(\sum_{n=0}^{n_{b+1}-n_b-1} X_{near,\tau_b}^b(n) * X_3^b(n)\right),$$

and the direction may be obtained of the dominant sound source for subband b:

$$\alpha_b = \begin{cases} \hat{\alpha}_b, & c_b^+ \geq c_b^- \\ -\hat{\alpha}_b, & c_b^+ \leq c_b^- \end{cases} \quad (29)$$

It has to be understood that the explained technique to define which of the signs in equation (23) is correct represents an example and that other techniques based on further information and/or based on the captured signal from the third microphone 203 may be used.

Thus, for instance, in step 342 of the method depicted in FIG. 3*b* angle $\alpha_b$ may be determined as directional information associated with the respective subband b based on the determined time delay $\tau_b$ associated with the respective subband b.

Accordingly, directional information associated with each subband of the at least one subband of the plurality of subbands can be determined based on the methods depicted in FIGS. 3*a* and 3*b*.

Figure 4:
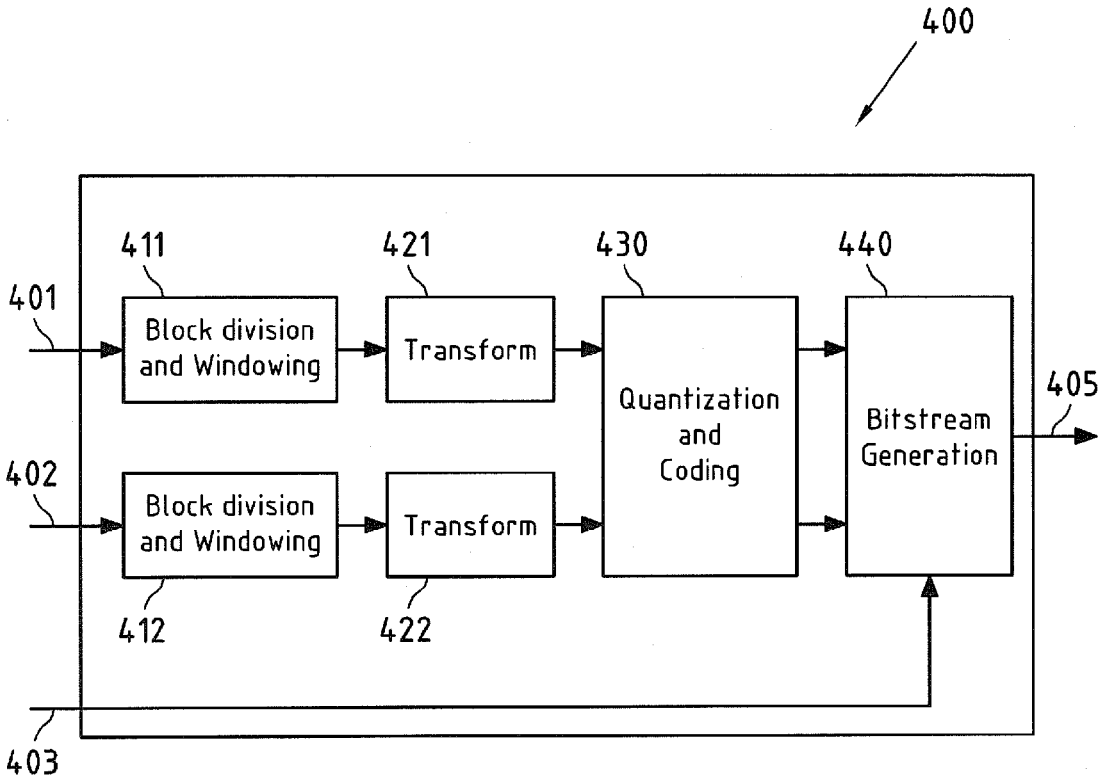
FIG. 4: a schematic block diagram of an example embodiment of an apparatus according to the first aspect of invention.

FIG. 4 depicts a schematic block diagram of a further example embodiment of an apparatus 400 according to the first aspect of invention.

This apparatus 400 may be used for encoding the left signal representation 401 and the right signal representation 402, wherein the left and right signal representations 401 and 402 are assumed to be in the time domain.

The left signal representation 401 is fed to an entity for block division and windowing 411, wherein this entity 411 may be configured to generate windows with a predefined overlap and an effective length, wherein this predefined overlap map represent 50 or another well-suited percentage, and wherein this effective length may be 20 ms or another well-suited length. Furthermore, the entity 411 may be configured to add $D_{tot}=D_{max}+D_{HRTF}$ zeroes to the end of the window, wherein $D_{max}$ may correspond to the maximum delay in samples between the microphones, as explained with respect to the method depicted in FIG. 3.

The entity for block division and windowing 412 receives the right signal representation 401 and is configured to generate windows with a predefined overlap and an effective length in the same way as entity 411.

The windows formed by entities configured to generate windows with a predefined overlap and an effective length 411, 412 are fed to the respective transform entity 421, 422, wherein transform entity 421 is configured to transform the windows of the left signal representation 401 to frequency domain, and wherein transform entity 422 is configured to transform the windows of the right signal representation 402 to frequency domain. This may be done in accordance with the explanation presented with respect to step 320 of FIG. 3*a*.

Thus, transform entity 421 may be configured to output $X_1(n)$ and transform entity 422 may be configured to output $X_2(n)$.

Entity 430 is configured to perform quantization end encoding to the left signal representation $X_1(n)$ in the frequency domain and to the right signal representation $X_2(n)$ in the frequency domain For instance, suitable audio codes may for instance be AMR-WB+, MP3, AAC and AAC+, or any other audio codec.

Afterwards, the quantized and encoded left and right signal representations are inserted into a bitstream 405 by means of bitstream generation entity 440.

The directional information 403 associated with at least one subband of the plurality of subbands associated with the left and the right signal representation is inserted into the bitstream 405 by means of the bitstream generation entity 440. Furthermore, for instance, the directional information 403 may be quantized and/or encoded before being inserted in the bitstream 405. This may be performed by entity 430 (not depicted in FIG. 4).

The directional information 403 may be indicative of the direction of the sound source 205 relative to the first and second microphone 201, 202 for a respective subband of the at least one subband of the plurality of subbands associated with the first and the second signal representation. For instance, the at least one subband of the plurality of subbands may represent a subset of subbands of the plurality of subbands or may represent the plurality of subbands.

As an example, the directional information may comprise an angle $\alpha_b$ representative of arriving sound relative to the first and second microphone 201, 202 for a respective subband for each of the at least one subband of the plurality of subbands.

Furthermore, for instance, the directional information may comprise a time delay $\tau_b$ for a respective subband b of the at least one subband of the plurality of subbands associated with the first and the second signal representation, the time delay being indicative of a time difference between the first signal representation and the second signal representation with respect to the sound source for the respective subband.

Furthermore, as an example, the directional information may comprise at least one of the following distances:

- a distance 212 (*d*) indicative of the distance between the first microphone 201 and the second microphone 202, and
- a distance 215, 225 (*a*) indicative of the distance between the sound source 205 and a microphone of the first and second microphone 201, 202.

For instance, the microphone of the first and second microphone 201, 202 may represent the microphone out of the first and second microphone 201, 202 being the nearest to the sound source 205

Furthermore, as an example, the apparatus 400 may comprise means for performing the directional analysis based on subband components of the left and right signal representation associated with a respective subband (not depicted in FIG. 4) in order to determine the directional information 403, wherein this means may be configured to implement steps 330, 340 and 350 of the method depicted in FIG. 3*a*. Thus, at least a part of the directional information 403 may be determined by the apparatus 400.

Figure 5:
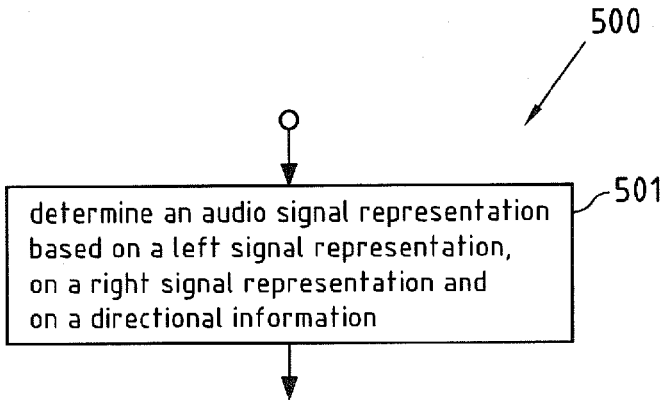
FIG. 5: a flowchart of a first example embodiment of a method according to a second aspect of the invention.

FIG. 5 shows a flowchart 500 of a method according to a first embodiment of a second aspect of the invention. The steps of this flowchart 500 may for instance be defined by respective program code 32 of a computer program 31 that is stored on a tangible storage medium 30, as shown in FIG.

1*b*. Tangible storage medium 30 may for instance embody program memory 11 of FIG. 1*a*, and the computer program 31 may then be executed by processor 10 of FIG. 1*a*.

In step 510 of the method 500 according to a first embodiment of the second aspect of the invention, an audio signal representation is determined based on a left signal representation, on a right signal representation and on directional information, wherein each of the left and right signal representations being associated with a plurality of subbands of a frequency range, and wherein the directional information is associated with at least one subband of the plurality of subbands associated with the left and the right signal representation, the directional information being indicative of a direction of a sound source 205 with respect to the left and right audio channel.

The left signal representation, the right signal representation, and the directional information may represent the left and right signal representation provided by the first aspect of the invention. For instance, any explanation presented with respect to the right and left signal representation and to the directional information in the first aspect of the invention may also hold for the right and left signal representation and the directional information of the second aspect of the invention.

For instance, said audio signal representation may comprise a plurality of audio channel representations. For instance, said plurality of audio channel signal representations may comprise two audio channel signal representations, or it may comprise more than two audio channel signal representations. As an example, said audio signal representation may represent a spatial audio signal representation. The plurality of audio channel representations may for instance by determined based on the first and second signal representation and on the directional information. As an example, the spatial audio representation may represent a binaural audio representation or a multichannel audio representation.

Thus, the second aspect of the invention allows to determine a spatial audio representation based on the first and second signal representation and based on the directional information.

Furthermore, since the right signal representation is associated with the right audio signal and since the left signal representation is associated with the left audio signal, it is possible to generate or obtain a Left/Right-stereo representation of audio based on the left and right signal representation. Thus, although the right and left signal representation and the directional information may be used for determining a spatial audio representation, this representation comprising the left and right signal representation is completely backwards compatible, i.e. it is possible to generate or obtain a Left/Right-stereo representation of audio based on the left and right signal representation.

For instance, before step 510 is performed, an optional decoding of an encoded representation may be performed, wherein this encoded representation may comprise an encoded left representation of the left signal representation and an encoded right representation for the right signal representation. Thus, a decoding process may be performed in order to obtain the left signal representation and the right signal representation from the encoded representation. Furthermore, as an example, the encoded representation may comprise an encoded directional information of the directional information. Then, the decoding process may also be used in order to obtain the directional information from the encoded representation.

The directional information may be indicative of the direction of a sound source 205 relative to a first and a second microphone 201, 202 for a respective subband of the at least one subband of the plurality of subbands associated with the left and right signal representation, e.g. as exemplarily explained with respect to the microphone arrangement depicted in FIG. 2*b*.

For instance, the audio representation comprises a plurality of audio channel signal representations, wherein at least one of the audio channel signal representation may for instance be associated with a channel of a spatial audio signal representation, and wherein the directional information is used to generate an audio channel signal representation of the at least one audio channel signal representation in accordance with the desired channel.

As a non-limiting example, the directional information may comprise an angle $\alpha_b$ representative of arriving sound relative to the first and second microphone 201, 202 for a respective subband b of the at least one subband of the plurality of subbands associated with the left and right signal representation.

For instance, an audio channel signal representation of the plurality of audio channel signal representations may be associated with at least one subband of the plurality of subbands. Thus, for instance, an audio channel signal representation of the plurality of audio channel signal representations may comprise a plurality of subband components, wherein each of the subband components is associated with a subband of the plurality of subbands. For instance, a frequency range in the frequency domain may be divided into the plurality of subbands. Nevertheless, the audio channel representation may be a representation in the time domain or a representation in the frequency domain.

Then, as an example, at least one audio channel signal representation of the plurality of audio channel signal representation may be determined based on the left and right signal representation and at least partially based on the directional information, wherein subband components of the respective audio channel signal representations having dominant sound source directions may be emphasized relative to subbands components having less dominant sound source directions. Furthermore, for instance, an ambient signal representation may be generated based on the left and right channel representation in order to create a more pleasant and natural sounding sound, wherein this ambient signal representation may be combined with the respective audio channel signal representation of the plurality of audio channel signal representations. Said combining may be performed in the time domain or in the frequency domain. Thus, the respective audio channel signal representation comprises or includes said ambient signal representation at least partially after this combining is performed. For instance, said combining may comprise adding the ambient signal representation to the respective audio channel signal representation.

Furthermore, as an example, before said combining is performed, a decorrelation may be performed on the ambient signal representation. As an example, this decorrelation may be performed in a different manner depending on the audio channel signal representation of the plurality of audio channel signal representations. Thus, for instance, the same ambient signal representation may be used as a basis to be combined with several audio channel signal representations, wherein different decorrelations are performed to the ambient signal representation in order to generate a plurality of different decorrelated ambient signal representations, wherein each of the plurality of different decorrelated ambient signal representation may be respectively combined with the respective audio channel signal representation of the several audio channel signal representations.

Figure 6A:
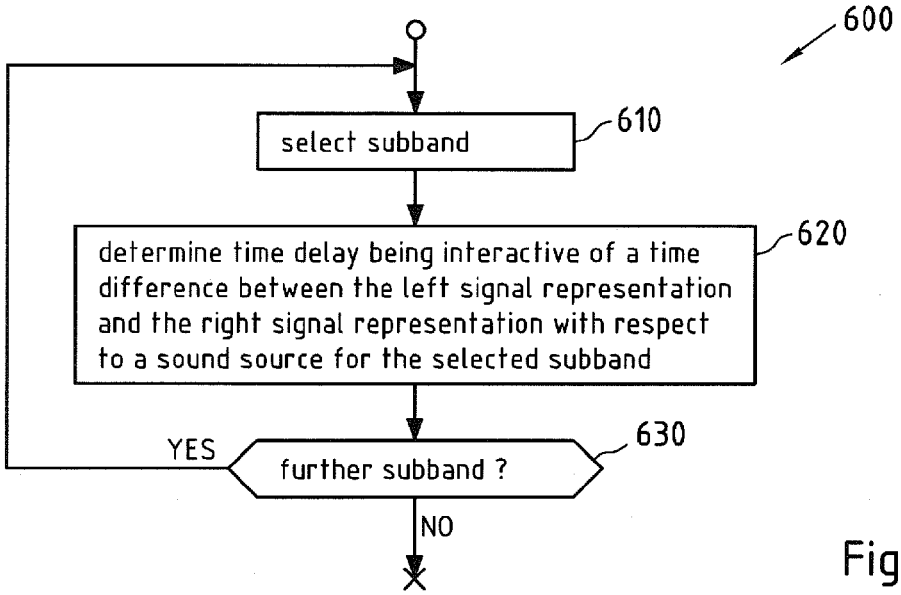
FIG. 6*a*: a flowchart of a second example embodiment of a method according to the second aspect the invention.

FIG. 6*a* shows a flowchart 600 of a method according to a second embodiment of a second aspect of the invention.

In accordance with this method depicted in FIG. 6*a*, for each subband of at least one subband of the plurality of subbands associated with the left and right signal representations a time delay $\tau_b$ for the respective subband b is determined based on the directional information of this subband in step 620, the time delay $\tau_b$ being indicate of a time difference between the left signal representation and the right signal representation with respect to the sound source 205 for the respective subband b.

For instance, the directional information may comprise the time delay $\tau_b$ for the respective subband of at least one subband of the plurality of subbands. In this case, time delay $\tau_b$ for the respective subband can be directly obtained from the directional information.

If the time delay $\tau_b$ for the respective subband is not directly available from the directional information, the time delay $\tau_b$ may be calculated based on the directional information of the respective subband.

Furthermore, for instance, it may assumed without any limitation that the directional information may comprise the angle $\alpha_b$ representative of arriving sound relative to the first and second microphone 201, 202 for a respective subband b of the at least one subband of the plurality of subbands associated with the left and right signal representation. Then, if the directional information comprises an angle $\alpha_b$ representative of arriving sound relative to the first and second microphone 201, 202 for the respective subband b, the time delay $\tau_b$ may be calculated based on this angle $\alpha_b$. Furthermore, additional information on the arrangement of microphones 201, 202 in the predetermined geometric configuration may be used for calculating the time delay $\tau_b$. As an example, this additional information may be included in the directional information or it may be made available in different way, e.g. as a kind of a-prior information, e.g. by means of stored information of a decoder.

For instance, the directional information may comprise at least one of the following distances: a distance indicative of the distance between the first and second microphone, and a distance indicative of the distance between the sound source and a microphone of the first and second microphone.

Thus, the additional information on the arrangement of the two or more microphones 201, 202 in the predetermined geometric configuration may comprise said at least one of the above mentioned distances.

In the sequel, an exemplary approach for calculating the time delay $\tau_b$ based on directional information and the above-mentioned additional information is be presented, but it has to be understood that other approaches of calculating the time delay $\tau_b$ based on directional information may be applied. For instance, such another approach may depend on the specific geometric configuration of the two or more microphones 201, 202 with respect to the dominant sound source 205.

It is assumed, that the directional information comprises an angle $\alpha_b$ representative of arriving sound relative to the first and second microphone 201, 202 for the selected subband b (step 610) of the at least one subband of the plurality of subbands.

Then, for instance, in step 620, the difference in distance $\Delta_{12,b}$ between the distance 215 ($a+\Delta_{12,b}$) of the farthest microphone 201 of the first and second microphone 201, 202 to the sound source 205 and the distance of the nearest microphone 202 of the first and second microphone 201, 202 to the sound source 205 may be determined. This may be performed based on angle $\alpha_b$ and the additional information on the arrangement of microphones 201, 202 in the predetermined geometric configuration.

For instance, if the distance a between the nearest microphone 202 of the first and second microphone 201, 202 to the sound source 205 is known, e.g. based on an estimation, and if the distance d between the first microphone 201 and the second microphone 202 is known, the difference in distance $\Delta_{12,b}$ might be exemplarily determined as follows:

$$\Delta_{12,b}=\sqrt{(a\cos(\alpha_b)+d)^2+(a\sin(\alpha_b))^2} \tag{30}$$

It has to be understood that other suited approaches for determining the difference in distance $\Delta_{12,b}$ may be performed.

Based on the difference in distance $\Delta_{12,b}$ a time delay $\tau_b$ may be determined for the selected subband b:

$$\tau_b = \begin{cases} \frac{\Delta_{12,b}}{v} F_s, & \frac{\pi}{2} + \sin^{-1}\left(\frac{d/2}{a}\right) \le \alpha_b < \frac{3\pi}{2} - \sin^{-1}\left(\frac{d/2}{a}\right) \\ -\frac{\Delta_{12,b}}{v} F_s, & -\frac{\pi}{2} - \sin^{-1}\left(\frac{d/2}{a}\right) \le \alpha_b < \frac{\pi}{2} + \sin^{-1}\left(\frac{d/2}{a}\right) \end{cases}, \tag{31}$$

where Fs is the sampling rate and v is the speed of sound. As explained with respect to the exemplary geometric configuration depicted in FIG. 2*b*, if the sound comes to the first microphone 201 first, then time delay $\tau_b$ is positive and if sound comes to the second microphone 202 first, then time delay $\tau_b$ is negative. It has to be understood that another definition of the time delay $\tau_b$ may be used, i.e. the time delay $\tau_b$ may be negative if sound comes to the second microphone 202 first and the time delay $\tau_b$ may be positive if sound comes to the first microphone 201 first.

Returning to FIG. 6, in step 630 it is determined whether there is a further subband of the at least one subband of the plurality of subbands for which a time delay $\tau_b$ should be determined. If yes, then the methods proceeds with step 610 and selects the respective subband.

Thus, in accordance with the method depicted in FIG. 6, for each of the at least one subband of the plurality of subbands associated with the left and right signal representation a time delay $\tau_b$ associated with the respective subband b can be determined. Accordingly, at least one time delay $\tau_b$ associated with the at least one subband of the plurality of subbands can be determined.

For instance, based on the at least one determined time delay $\tau_b$ associated with the at least one subband of the plurality of subbands, a spatial audio signal representation may be determined.

Figure 6B:
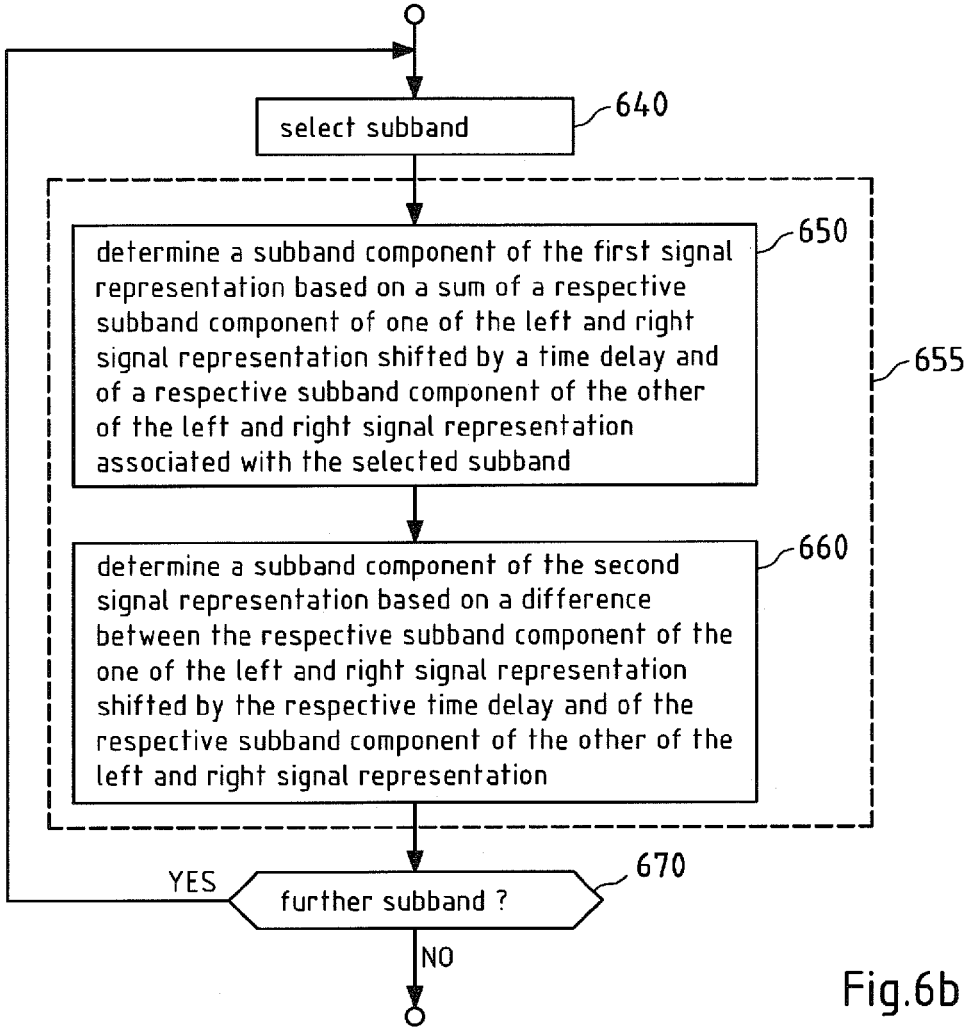
FIG. 6*b*: a flowchart of a third example embodiment of a method according to the second aspect the invention.

FIG. 6*b* depicts a flowchart 600 of a third example embodiment of a method according to the second aspect the invention, which can be used for determining the audio signal representation.

Said determining the audio signal representation comprises determining a first signal representation $S_1(n)$ and a second signal representation $S_2(n)$, wherein said determining of a first and second signal representation comprises for each of at least one subband of the plurality of subbands associated with the left signal representation $X_1(n)$ and the right signal representation $X_2(n)$.

It may be assumed that the first and second signal representation is in the frequency domain. For instance, a subband component of a kth signal representation $S_k(n)$ may be denoted $S_k^b(n)$. For instance, it has to be understood that the first and second signal representations may be in the time domain.

In accordance with the method depicted in FIG. 6*b*, in step 640 a subband of the at least one subband of the plurality of subbands is selected.

In step 640, a subband component $S_1^b(n)$ of the first signal representation $S_1(n)$ is determined based on a sum of a respective subband component of one of the left and right signal representation shifted by a time delay $\tau_b$ and of a respective subband component of the other of the left and right signal representation, the time delay $\tau_b$ being indicative of a time difference between the left signal representation and the right signal representation with respect to the sound source for the respective subband.

Thus, for instance, the respective subband component of one of the left and right representation shifted by a time delay $\tau_b$ may be the respective subband component $X_1^b(n)$ of the first signal representation shifted by the time delay $\tau_b$, i.e. the respective subband component of one of the left and right signal representation shifted by a time delay may be $X_{1,\tau_b}^b(n)$ (or $X_{1,-\tau_b}^b(n)$), and the respective subband component of the other of the left and right signal representation may be $X_2^b(n)$. Then, the subband component $S_1^b(n)$ of the first signal representation $S_1(n)$ may be determined based on the sum of the respective time shifted subband component of one of the left and right signal representation $X_{1,\tau_b}^b(n)$ and the respective subband component of the other of the left and right signal representation $X_2^b(n)$.

The shift of the subband component of the one of the left and right signal representation by the time delay $\tau_b$ may be performed in a way that a time difference between the time-shifted subband component (e.g. $X_{1,\tau_b}^b(n)$ or $X_{1,-\tau_b}^b(n)$) of the one of the left and right signal representation and the subband component (e.g. $X_2^b(n)$) of the other of the left and right signal representation is at least mostly removed. Thus, the time-shift applied to the subband component (e.g.) $X_1^b(n)$ of the one of the left and right signal representation enhances or maximizes the similarity between the time-shifted subband component (e.g. $X_{1,\tau_b}^b(n)$ or $X_{1,-\tau_b}^b(n)$) of the one of the left and right signal representation and the subband component (e.g.) $X_2^b(n)$ of the other of the left and right signal representation.

For instance, if a positive time delay $\tau_b$ indicates that the sound comes to the left audio channel (e.g., the first microphone 201) first, then the respective subband component of one of the left and right signal representation shifted by a time delay may be $X_{1,\tau_b}^b(n)$, and the respective subband component of the other of the left and right signal representation may be $X_2^b(n)$, and the subband component $S_1^b(n)$ may be determined by $$S_1^b(n)=X_{1,\tau_b}^b(n)+X_2^b(n). \tag{32}$$

Thus, the signal component represented by the subband component $X_1^b(n)$ is delayed by time delay $\tau_b$, since an audio signal emitted from a sound source 205 reaches the first microphone 201 being associated with the left channel representation $X_1(n)$ prior to the the second microphone 202 being associated with the right channel representation $X_2(n)$.

Or, for instance, if a positive time delay $\tau_b$ indicates that the sound comes to the right audio channel (e.g., the second microphone 202) first, then the respective subband component of one of the left and right signal representation shifted by a time delay may be $X_{1,-\tau_b}^b(n)$, and the respective subband component of the other of the left and right signal representation may be $X_2^b(n)$, and the subband component $S_1^b(n)$ may be determined by $$S_1^b(n)=X_{1,-\tau_b}^b(n)+X_2^b(n) \tag{33}$$

Or, as another example, the respective subband component of one of the left and right representation shifted by a time delay $\tau_b$ may be the respective subband component $X_2^b(n)$ of the second signal representation shifted by the time delay $\tau_b$, i.e. the respective subband component of one of the left and right signal representation shifted by a time delay may be $X_{2,-\tau_b}^b(n)$ (or $X_{2,\tau_b}^b(n)$), and the respective subband component of the other of the left and right signal representation may be $X_1^b(n)$. Then, the subband component $S_1^b(n)$ of the first signal representation $S_1(n)$ may be determined based on the sum of the respective time shifted subband component of one of the left and right signal representation $X_{2,-\tau_b}^b(n)$ (or $X_{2,\tau_b}^b(n)$) and the respective subband component of the other of the left and right signal representation $X_1^b(n)$.

For instance, if a positive time delay $\tau_b$ indicates that the sound comes to the left audio channel (e.g., the first microphone 201) first, then the respective subband component of one of the left and right signal representation shifted by a time delay may be $X_{2,-\tau_b}^b(n)$, and the respective subband component of the other of the left and right signal representation may be $X_1^b(n)$, and the subband component $S_1^b(n)$ may be determined by $$S_1^b(n)=X_1^b(n)+X_{2,-\tau_b}^b(n). \tag{34}$$

Or, for instance, if a positive time delay $\tau_b$ indicates that the sound comes to the right audio channel (e.g., the second microphone 202) first, then the respective subband component of one of the left and right signal representation shifted by a time delay may be $X_{2,\tau_b}^b(n)$, and the respective subband component of the other of the left and right signal representation may be $X_1^b(n)$, and the subband component $S_1^b(n)$ may be determined by $$S_1^b(n)=X_1^b(n)+X_{2,\tau_b}^b(n). \tag{35}$$

As an example, under the non-limiting assumption that a positive time delay $\tau_b$ indicates that the sound comes to the left audio channel (e.g., the first microphone 201) first, the subband component $S_1^b(n)$ may be determined as follows:

$$S_1^b = \begin{cases} X_1^b + X_{2,-\tau_b}^b, & \tau_b \geq 0 \\ X_1^b + X_{2,-\tau_b}^b, & \tau_b < 0 \end{cases} \tag{36}$$

Thus, the subband component associated with the channel of the left and right channel in which the sound comes first may be added as such, whereas the subband component associated the channel in which the sound comes later may be shifted. Similarly, for instance, under the non-limiting assumption that a positive time delay $\tau_b$ indicates that the sound comes to the right audio channel (e.g., the second microphone 201) first, the subband component $S_1^b(n)$ may be determined as follows:

$$S_1^b = \begin{cases} X_{1,-\tau_b}^b + X_2^b, & \tau_b \geq 0 \\ X_1^b + X_{2,\tau_b}^b, & \tau_b < 0 \end{cases} \tag{37}$$

Furthermore, as an example, it has to be noted that subband component $S_1^b(n)$ may be weighted with any factor, i.e. $S_1^b(n)$ might be multiplied with a factor f. For instance, f might be f=0.5, or f might be any other value.

For instance, the first signal representation $S_1(n)$ may be used as a basis for determining at least one audio channel signal representation of the plurality of audio channel signal representations. As an example, the plurality of audio channel signal representations may represent k audio channel signal representations $C_i(n)$, wherein $i \in \{1,K,k\}$ holds, and wherein $C_i^b(n)$ represents a bth subband component of the ith channel signal representation. Thus, an audio channel signal representation $C_i(n)$ may comprise a plurality of subband components $C_i^b(n)$, wherein each subband component $C_i^b(n)$ of the plurality of subband components may be associated with a respective subband b of the plurality of subbands.

As an example, subband components of an ith audio channel signal representation $C_i(n)$ having dominant sound source directions may be emphasized relative to subbands components of the ith audio channel signal representation $C_i(n)$ having less dominant sound source directions.

In step 650, a subband component $S_2^b(n)$ of the second signal representation $S_2(n)$ is determined based on a difference between the respective subband component of one of the left and right signal representation shifted by the time delay $\tau_b$ and the respective subband component of the other of the left and right signal representation.

For instance, for the exemplary scenario explained with respect to equation (32), i.e. $X_{1,\tau_b}^b(n)$ representing the respective subband component of one of the left and right signal representation shifted by the time delay $\tau_b$ and $X_2^b(n)$ representing the respective subband component of the other of the left and right signal representation, the corresponding subband component $S_2^b(n)$ may be determined by $$S_2^b(n)=X_{1,\tau_b}^b(n)-X_2^b(n). \tag{38}$$

Or, for instance, for the exemplary scenario explained with respect to equation (33), i.e. $X_{1,-\tau_b}^b(n)$ representing the respective subband component of one of the left and right signal representation shifted by the time delay $\tau_b$ and $X_2^b(n)$ representing the respective subband component of the other of the left and right signal representation, the corresponding subband component $S_2^b(n)$ may be determined by $$S_1^b(n)=X_{1,-\tau_b}^b(n)-X_2^b(n). \tag{39}$$

For instance, for the exemplary scenario explained with respect to equation (34), i.e. $X_1^b(n)$ representing the respective subband component of one of the left and right signal representation shifted by the time delay $\tau_b$ and $X_{2,-\tau_b}^b(n)$ representing the respective subband component of the other of the left and right signal representation, the corresponding subband component $S_2^b(n)$ may be determined by $$S_2^b(n)=X_1^b(n)-X_{2,-\tau_b}^b(n). \tag{40}$$

Or, for instance, for the exemplary scenario explained with respect to equation (35), i.e. $X_1^b(n)$ representing the respective subband component of one of the left and right signal representation shifted by the time delay $\tau_b$ and $X_{2,\tau_b}^b(n)$ representing the respective subband component of the other of the left and right signal representation, the corresponding subband component $S_2^b(n)$ may be determined by $$S_2^b(n)=X_1^b(n)-X_{2,\tau_b}^b(n). \tag{41}$$

As an example, under the non-limiting assumption that a positive time delay $\tau_b$ indicates that the sound comes to the left audio channel (e.g., the first microphone 201) first, the subband component $S_2^b(n)$ may be determined as follows:

$$S_2^b = \begin{cases} X_1^b - X_{2,-\tau_b}^b, & \tau_b \geq 0 \\ X_1^b - X_{2,-\tau_b}^b, & \tau_b < 0 \end{cases} \tag{42}$$

may hold. Thus, the subband component associated with the channel of the left and right channel in which the sound comes first may be taken as such, whereas the subband component associated the channel in which the sound comes later may be shifted. Similarly, for instance, under the non-limiting assumption that a positive time delay $\tau_b$ indicates that the sound comes to the right audio channel (e.g., the second microphone 201) first, the subband component $S_2^b(n)$ may be determined as follows:

$$S_2^b = \begin{cases} X_{1,-\tau_b}^b - X_2^b, & \tau_b \geq 0 \\ X_1^b - X_{2,\tau_b}^b, & \tau_b < 0 \end{cases} \tag{43}$$

Furthermore, as an example, it has to be noted that subband component $S_2^b(n)$ might be weighted with any factor, i.e. $S_2^b(n)$ might be multiplied with a factor f. For instance, f might be f=0.5, or f might be any other value. For instance, this weighting factor may be the same weighting factor used for subband component $S_1^b(n)$.

In step 670 it is checked whether there is a further subband of the at least one subband of the plurality of subbands, and if there is a further subband, the method proceeds with selecting one of the further subband in step 330.

Thus, for instance, the subband components $S_1^b(n)$ of the first signal representation $S_1(n)$ and the subband components $S_2^b(n)$ of the second signal representation $S_2(n)$ may be determined by means of the method depicted in FIG. 6*b*.

Furthermore, as an example, steps 650 and 660 depicted in FIG. 6*b*, indicated as combined steps 655 by dashed lines, might be included in the loop depicted in FIG. 6*a*, e.g. between steps 620 and 630.

For instance, if the audio representation represents a binaural audio representation, the first signal representation $S_1(n)$ may represent a mid signal representation including a sum of a shifted signal representation (a time-shifted one of the left and right signal representation) and a non-shifted signal (the other of the left and right signal representation), and the second signal representation $S_2(n)$ may represent a side signal including a difference between a time-shifted signal of one of the left and right signal representation) and a non-shifted signal (the other of the left and right signal representation).

As an example, said second signal representation $S_2(n)$ may be considered to represent an ambient signal representation generated based on the left and right channel representation, wherein this second signal representation $S_2(n)$ may be used to create a more pleasant and natural sounding sound. For instance, the ambient signal representation $S_2(n)$ may be combined with an audio channel signal representation $C_i(n)$ of the plurality of audio channel signal representations. Thus, the respective audio channel signal representation comprises or includes said ambient signal representation at least partially after this combining is performed. Said combining may be performed in the time domain or in the frequency domain. For instance, said combining may comprise adding the ambient signal representation to the respective audio channel signal representation.

Furthermore, as an example, before said combining is performed, a decorrelation may be performed on the ambient signal representation, as mentioned above. As an example, this decorrelation may be performed in a different manner depending on the audio channel signal representation of the plurality of audio channel signal representations. Thus, for instance, each of at least two audio channel signal representations may be combined with a respective different decorrelated ambient signal representation, i.e. at least two different decorrelated ambient signal representations may be generated based on the ambient signal representation $S_2(n)$, wherein these at least two different decorrelated ambient signal representations are at least partially decorrelated from each other.

Thus, as example, if the audio representation represents a multichannel audio representation comprising a plurality of audio channel representations, said plurality of audio channel representations $C_i(n)$ may be determined based on the first signal representation $S_1(n)$ and on the second signal representation $S_2(n)$.

Figure 7:
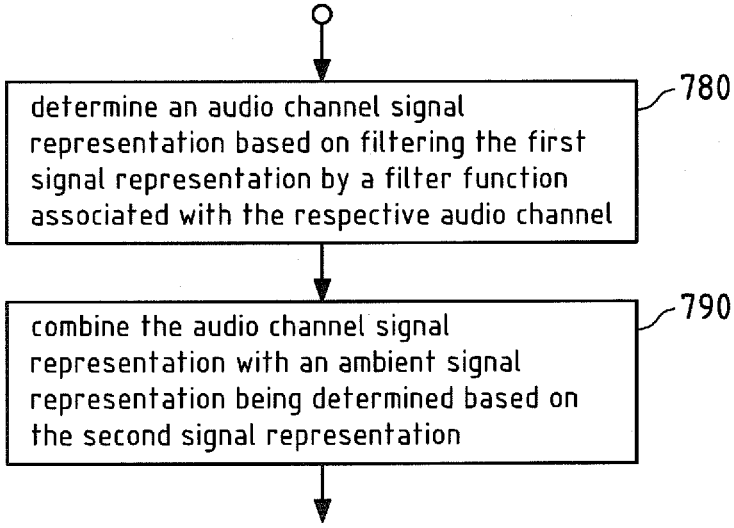
FIG. 7: a flowchart of a third example embodiment of a method according to the second aspect the invention.

FIG. 7 depicts a flowchart of a third example embodiment of a method according to the second aspect the invention.

In accordance with this third example embodiment of a method according to the second aspect of the invention, at least one audio channel signal representation $C_i(n)$ of the plurality of channel signal representations is determined.

In step 780, an audio channel signal representation $C_i(n)$ of the plurality of audio channel signal representations is determined based on filtering the first signal representation $S_1(n)$ by a first filter function associated with the respective audio channel, wherein said filter function is configured to filter at least one subband component of the first signal representation based on the directional information.

For instance, it may be assumed without any limitation that the directional information may comprise the angle $\alpha_b$ representative of arriving sound relative to the first and second microphone 201, 202 for a respective subband b of the at least one subband of the plurality of subbands associated with the left and right signal representation. It has to be understood that other directional information may be used for performing the filter function.

Thus, in step 780, an ith channel representation $C_i(n)$ may be determined based on the first signal representation $S_1(n)$ and on the directional information in accordance with a filter function $f_i(n)$ associated with the ith channel. Thus, for at least one subband of the plurality of subbands the respective subband component $C_i^b(n)$ of the ith channel signal representation may be determined by $$C_i^b(n)=f_c^b(S_1^b,\alpha_b). \tag{44}$$

As a non-limiting example, the filter function may comprise filtering the respective subband component of the respective first signal representation $S_1^b(n)$ with a predefined transfer function associated with the ith channel.

For instance, the filter function may comprise weighting a subband component of the respective first signal representation $S_1^b(n)$ with a respective weighting factor, wherein the weighting factor may depend on the directional information $\alpha_b$. Thus, for instance, for at least one subband of the plurality of subbands, the respective subband component $C_i^b(n)$ an ith audio channel signal representation may be determined by $$C_i^b(n)=g_i^b(\alpha_b)S_1^b(n), \tag{45}$$

wherein g $(\alpha_b)$ represents the weighting factor associated with the ith channel and the subband b. As an example, said weighing factors $g_i^b(\alpha_b)$ may be adjusted so that subband components $C_i^b(n)$ associated with subbands having dominant sound source directions may be emphasized relative to subband components $C_i^b(n)$ associated with subbands having less dominant sound source directions. As an example, equation (45) may be applied to at least two subbands of the plurality of subbands on order to determine an ith audio channel signal representation $C_i^b(n)$, wherein said at least two subbands may for instance represent the plurality subbands.

As an example, said weighting factors associated with an ith channel and a subband b may be determined based on a specific spatial audio channel model comprising at least two audio channels and comprising a predefined rule for determining the weighting factors for an ith audio channel of the at least two audio channel based on the directional information $\alpha_b$. For instance, said spatial audio channel model may be a model associated with a 2.1, 5.1., 7.1, 9.1, 11.1 or any other multichannel spatial audio channel system or stereo system.

As an example, with respect to an exemplary 5.1 multichannel system described in "Continuous surround panning for 5-speaker reproduction", P. G. Craven, AES 24$^{th}$ International Conference on Multi-channel Audio, June 2003, the weighting factors associated for a subband b (of the plurality of subbands) may be obtained as a function of the directional information $\alpha_b$ for the different channels of the five audio channels as follows:

$$g_i^b(\alpha_b)=0.10492+0.33223\cos(\theta)+0.26500\cos(2\theta)+0.16902\cos(3\theta)+0.05978\cos(4\theta);$$

$$g_2^b(\alpha_b)=0.16656+0.24162\cos(\theta)+0.27215\sin(\theta)-0.05322\cos(2\theta)+0.22189\sin(2\theta)-0.08418\cos(3\theta)+0.05939\sin(3\theta)-0.06994\cos(4\theta)+0.08435\sin(4\theta);$$

$$g_3^b(\alpha_b)=0.16656+0.24162\cos(\theta)-0.27215\sin(\theta)-0.05322\cos(2\theta)-0.22189\sin(2\theta)-0.08418\cos(3\theta)-0.05939\sin(3\theta)-0.06994\cos(4\theta)-0.08435\sin(4\theta);$$

$$g_4^b(\alpha_b)=0.35579-0.35965\cos(\theta)+0.42548\sin(\theta)-0.06361\cos(2\theta)-0.11778\sin(2\theta)+0.00012\cos(3\theta)-0.04692\sin(3\theta)+0.02722\cos(4\theta)-0.06146\sin(4\theta);$$

$$g_5^b(\alpha_b)=0.35579-0.35965\cos(\theta)-0.42548\sin(\theta)-0.06361\cos(2\theta)+0.11778\sin(2\theta)+0.00012\cos(3\theta)+0.04692\sin(3\theta)+0.02722\cos(4\theta)+0.06146\sin(4\theta). \tag{46}$$

In this example, channel 1 represents a mid channel, i.e., weighting factor $g_i^b(\alpha_b)$ is associated with a subband b of the mid channel, channel 2 represents a front left channel, i.e., weighting factor $g_2^b(\alpha_b)$ is associated with a subband b of the front left channel, channel 3 represents a front right channel, i.e., weighting factor $g_3^b(\alpha_b)$ is associated with a subband b of the front right channel, channel 4 represents a rear left channel, i.e., weighting factor $g_4^b(\alpha_b)$ is associated with a subband b of the rear left channel, and channel 5 represents a rear right channel, i.e., weighting factor $g_5^b(\alpha_b)$ is associated with a subband b of the rear left channel. It has to be understood that other multi-channel systems may be applied and that other rules for determining the weighting factors for an ith audio channel of the at least two audio channel of the multi-channel system may be used.

Furthermore, as an example, if the directional information for a subband b is a predefined representative indicating that no directional information is available, e.g., this predefined representative may be any well-suited valued being outside the range of angles used for directional information or a code word like "empty", then the corresponding weighting factors associated with the subband b may be set to fixed values for the channels of the at least two audio channels:

$$g_i^b(\alpha_b=0)=\delta_i^b \tag{47}$$

As an example, the fixed value $\delta_i^b$ associated with an ith channel of the at least two audio channels may be selected such that the sound caused by the first signal representation $S_1(n)$ is equally loud in all directional components of the first signal representation $S_1(n)$.

Or, for instance, the filter function may comprise filtering the respective subband component of the respective first signal representation $S_1^b(n)$ with a predefined transfer function with an ith channel. For instance, a transfer function may be given for each channel of said at least two audio channels, wherein this transfer function depend on the directional information $\alpha_b$ associated with a subband b of the plurality of subbands and may be denoted as $h_{i,\alpha_b}(t)$ in the time domain, thereby representing a time domain impulse response, or may be denotes as corresponding frequency domain representation $H_{i,\alpha_b}(n)$, wherein for instance the time domain impulse response $h_{i,\alpha_b}(t)$ might be transformed to frequency domain using DFT, as mentioned above, i.e., wherein required numbers of zeroes may be added to the end of the impulse responses to math the length of the transform window (N).

Filtering of the first signal representation may be performed in the time-domain or in the frequency domain. In the following example, it is assumed that the filtering is performed in the frequency domain. As an example, filtering in the frequency domain may lead to a reduced complexity.

Thus, in step 780, an ith channel representation $C_i(n)$ may be determined based on the first signal representation $S_1(n)$ and on the directional information in accordance with a first filter function $f_{1,i}(n)$ associated with the ith channel. Thus, for at least one subband of the plurality of subbands the respective subband component $C_i^b(n)$ of the ith channel signal representation may be determined by Thus, for instance, for at least one subband of the plurality of subbands, the respective subband component $C_i^b(n)$ of an ith audio channel signal representation of the plurality of channel signal signal representations may be determined by $$C_i^b(n)=S_1^b(n)H_{i,\alpha_b}(n_b+n),\ n=0,K,n_{b+1}-n_b-1. \tag{48}$$

For instance, equation (48) may be performed for each subband of the plurality of subbands.

As another example, equation (48) may be performed for a subset of subbands of the plurality of subbands. For instance, said subset of subbands may be associated with lower frequencies of the frequency range. Thus, the filtering with the transfer function $H_{i,\alpha_b}(n)$ may be applied to subbands below a predefined frequency in order to determine respective subband components associated with these subbands for a respective ith audio channel, these subbands below the predefined frequency defining the subset of subbands of the plurality of subbands, whereas for subbands equal or higher the predefined frequency another filtering is applied. For instance, this another filtering may be weighting a respective subband component $S_1^b(n)$ of the respective first signal representation with a magnitude part of the transfer function $H_{i,\alpha_b}(n)$, i.e., the delay is not modified by this magnitude part, and adding a fixed time delay $\tau_H$ to the signal component, e.g. as follows:

$$C_i^b(n) = S_1^b(n)|H_{i,\alpha_b}(n_b+n)|e^{-j\frac{2\pi(n+n_b)\tau_H}{N}},\ n=0,\ K,\ n_{b+1}-n_b-1 \tag{49}$$

The fixed delay $\tau_H$ may represent the average delay introduced by the filtering with the transfer function. For instance, this average delay may be determined based on all transfer function components $H_{i,\alpha_b}(n)$ associated with all subbands of the plurality subbands or may be determined only based on the transfer function components $H_{i,\alpha_b}(n)$ associated with subbands of the subset of subbands of the plurality of subbands.

As a non-limiting example, the transfer function associated with an ith channel representation $C_i(n)$ may represent a head related transfer function (HRTF) which may be used to synthesize a binaural signal. In this example, the at least two audio channel signal representations may comprise a left audio channel signal representation, e.g. associated with i=1, and a right audio channel signal representation, e.g. associated with i=2, wherein the audio channel representation $C_1(n)$ associated with the left audio channel (i=1) is filtered with a transfer function $h_{1,\alpha_b}(t)$ associated with the left channel, and wherein the audio channel representation $C_2(n)$ associated with the right channel (i=2) is filtered with a transfer function $h_{2,\alpha_b}(t)$ associated with the left channel. For instance, determining the HRTF transfer functions $h_{1,\alpha_b}(t)$, $h_{2,\alpha_b}(t)$ may be performed or be based on the HRTF description in T. Huttunen, E. T. Seppälä, O. Kirkeby, A. Kärkkäainen, and L. Kärkkäinen, "Simulation of the transfer function for a head- and torso model over the entire audible frequency range," To appear in Journal of Computational Acoustics, 2008. For instance, determining the subband components $C_i^b(n)$ of the left audio channel signal representation $C_1(n)$ and the subband components $C_2^b(n)$ of the right audio channel signal representation $C_2(n)$ may be performed in the frequency domain based on frequency domain representations $H_{1,\alpha_b}(n)$, $H_{2,\alpha_b}(n)$ of the transfer functions, as mentioned above. For instance, equation (48) may be performed for a subset of subbands of the plurality of subbands, said subset of subbands may be associated with lower frequencies of the frequency range, wherein equation (49) may be performed higher frequencies. As an example, the subbands of the subset of subbands may represent subbands associated with frequencies below a predefined frequency of approximately 1.5 kHz, whereas equation (49) may be performed for subbands associated with frequencies equal or higher this predefined frequency.

Furthermore, for instance, a smoothing operation may be performed on the gain factors $g_i^b(\alpha_b)$ associated with an ith channel of the at least two audio channels. As an example, this smoothing operation may represent a kind of low pass operation. For instance, an average value of a weighting factor $\hat{g}_i^b(\alpha_b)$ for a subband b of the plurality of subband for an ith channel may be determined based on an average value determined on gain factors associated with the same ith channel but with other subbands being different from subband b and on the weighting factor $g_i^b(\alpha_b)$. Accordingly, the smoothed weighting factors $\hat{g}_i^b(\alpha_b)$ may be used for weighting the subband components $S_1^b(n)$, wherein this may be performed for each subband of the plurality of subbands and for each channel of said at least two audio channels.

As an example, a smoothing filter h(k) with length of 2K+1 samples may be applied as follows:

$$\hat{g}_i^b(\alpha_b) = \sum_{k=0}^{2K}(h(k)g_i^{b-K+k}(\alpha_b)),\ K \le b \le B-(K+1) \tag{50}$$

For instance, filter h(k) may be selected that $$\sum_{k=0}^{2K} h(k) = 1$$

may hold. As an example, h(k) may be as follows:

$$h(k) = \left\{ \frac{1}{12}, \frac{1}{4}, \frac{1}{3}, \frac{1}{4}, \frac{1}{12} \right\}, k = 0, K, 4. \tag{51}$$

With respect to this exemplary smoothing filter h(k), for the K first and last subbands, a slightly modified smoothing may be used as follows:

$$\hat{g}_i^b(\alpha_b) = \frac{\sum_{k=K-b}^{2K} (h(k) g_i^{b-K+k}(\alpha_b))}{\sum_{k=K-b}^{2K} h(k)} \quad 0 \le b \le K, \tag{52}$$

$$\hat{g}_i^b(\alpha_b) = \frac{\sum_{k=0}^{K+B-1-b} (h(k) g_i^{b-K+k}(\alpha_b))}{\sum_{k=0}^{K+B-1-b} h(k)} \quad B-K \le b \le B-1.$$

It has to be understood that other kinds of smoothing filters may be applied.

Thus, for example, if for one individual subband the direction of arriving sound is estimated completely incorrect, the synthesis would generated a disturbed unconnected short sound event to a direction where there are not other sound sources. This kind of error may be disturbing in a multi-channel output format. Said smoothing operation can avoid or reduce the impact of such an incorrect estimation of direction of arriving sound for an individual subband.

In optional step 790 of the method depicted in FIG. 7, the respective audio channel signal representation $C_i(n)$ is combined with an ambient signal representation being determined based on the second signal representation.

For instance, said combining may introduce an ambient sound to the respective audio channel signal representation $C_i(n)$ based on the second signal representation $S_2(n)$. As an example, said ambient signal representation may represent the second signal representation $S_2(n)$, or said ambient signal representation may represent a signal representation being calculated based on the second signal representation $S_2(n)$.

As an example, said combining may comprise adding an ambient signal representation to the respective audio channel signal representation $C_i(n)$, wherein the adding may be performed in the frequency domain or in the time domain.

For instance, it may be assumed that an ith audio channel signal representation $C_i(n)$ determined in step 780 is in the frequency-domain. Then, if the combining is performed in the time-domain, the ith audio channel signal representation $C_i(n)$ may be transformed to a time-domain representation $C_i(z)$, e.g. by means of using an inverse DFT, and, if windowing has been used for transform to frequency domain, by applying a sinusoidal windowing, and, if overlap has been used for transform to frequency domain, by combing the overlapping frames of adjacent frames. For instance, this transform into time-domain may be performed for each of the plurality of audio channel signal representations $C_i(n)$.

Furthermore, the second signal representation $S_2(n)$ may be equally transformed to the time-domain, wherein the time-domain representation may be denoted as $S_2(z)$.

Then, for instance, at least one of the plurality of audio channel signal representations $C_i(z)$ in the time-domain may be determined based on adding the second signal representation $S_2(z)$ to a respective audio channel signal representation $C_i(z)$ of the plurality of audio channel signal representations $C_i(z)$:

$$C_i(z) = C_i(z) + \gamma A_i(z) \tag{53},$$

wherein $A_i(z)$ represents the second signal representation $S_2(z)$, Optional value $\gamma$ may represent a scaling factor which may be used to adjust the proportion of the ambience component $A_i(z)$. Thus, the respective ith audio channel signal representation $C_i(z)$ in the left hand side of equation (53) represents the combined ith audio channel signal presentation $C_i(z)$, wherein. For instance, this may be performed for each audio channel representations of the plurality of audio channel representations $C_i(z)$.

Furthermore, as an example, at least one of the plurality of audio channel signal representations $C_i(z)$ in the time-domain may be determined based on adding an ambient signal representation $A_i(z)$ to a respective audio channel signal representation $C_i(z)$ of the plurality of audio channel signal representations $C_i(z)$, wherein the ambient signal representation $A_i(z)$ is calculated or determined based on the second signal representation $S_2(z)$ and is associated with a respective ith audio channel signal representation:

$$C_i(z) = C_i(z) + \gamma A_i(z) \tag{54}$$

Optional value $\gamma$ may represent a scaling factor which may be used to adjust the proportion of the ambience component $A_i(z)$. Thus, for instance, a plurality of ambient signal representations may be determined, wherein an ambient signal representation $A_i(z)$ of the plurality of ambient signal representations is associated with at least one audio channel signal representation $C_i(z)$ of the plurality of audio channel signal representations. For instance, each ambient signal representation $A_i(z)$ of the plurality of ambient signal representations may be associated with a respective audio channel signal representation $C_i(z)$ of the plurality of audio channel signal representations.

For instance, an ambient signal representation $A_i(z)$ associated with a respective ith audio channel signal representations $C_i(z)$ may represent a decorrelated second signal representation $S_2(z)$. As an example, this decorrelation may be performed in a different manner depending on the audio channel signal representation of the plurality of audio channel signal representations. Thus, for instance, each of at least two audio channel signal representations may be respectively combined with a respective different decorrelated ambient signal representation, i.e. at least two different decorrelated ambient signal representations $A_i(z)$, $A_j(z)$ may be generated based on the second signal representation $S_2(n)$, wherein these at least two different decorrelated ambient signal representations are at least partially decorrelated from each other.

Thus, for instance, an ith ambient signal representation $A_i(z)$ associated with a respective ith audio channel signal representations $C_i(z)$ of the plurality of audio channel signal representations may be determined based on the second signal representation $S_2(z)$ and a decorrelation function $D_i(z)$ associated with the ith ambient signal representation $A_i(z)$, e.g. in the following way:

$$A_i(z)=D_i(z)S_2(z) \tag{55}$$

Thus, a plurality of decorrelation functions may be used, wherein a decorrelation function $D_i(z)$ of the plurality of decorrelations functions may be associated with a respective ith ambient signal representation $A_i(z)$ of the plurality of ambient signal representations. For instance, at least two decorrelation functions of the plurality of decorrelation functions may be different from each other and thus the corresponding at least two ambient signal representations are decorrelated at least partially from each other. Thus, for instance, the plurality of ambient signal representations may comprise individual ambient signal representations, wherein every individual ambient signal representation $A_i(z)$ is associated with a respective ith audio channel signal representations $C_i(z)$ of the plurality of audio channel signal representations.

As an example, an ith decorrelation function $D_i(z)$ of the plurality of decorrelation functions may be implemented by means of a decorrelation filter, e.g. an IIR or FIR filter. As an example, an allpass type of decorrelation filter may be used, wherein an example of a corresponding decorrelation function $D_i(z)$ of the decorrelation filter may be of the form:

$$D_i(z) = \frac{\beta_i + z^{-P_i}}{1 + \beta_i z^{-P_i}} \tag{56}$$

For instance, parameters $\beta_i$ and $P_i$ for an ith decorrelation function $D_i(z)$ are selected in a suitable manner such that any decorrelation function of the plurality of decorrelation functions is not too similar with another decorrelation function of the plurality of decorrelation functions, i.e., the cross-correlation between decorrelated ambient signal representations of the plurality of ambient signal representations must be reasonable low. Furthermore, as an example, the group delay of the plurality of decorrelation functions should be reasonable close to each other.

As an example, returning back to step 790 depicted in FIG. 7, combining an ith audio channel representation $C_i(z)$ with a respective ambient signal representation $A_i(z)$ might be performed based on adding the ambient signal representation $A_i(z)$ associated with the ith audio channel representation $C_i(z)$:

$$C_i(z)=C_i(z)+\gamma A_i(z) \tag{57}$$

Furthermore, if the respective ith ambient signal representation $A_i(z)$ represents a decorrelated ambient signal representation, wherein the decorrelation function introduced a group delay to the ith ambient signal representation $A_i(z)$, the combining may comprise delaying the ith audio channel representation $C_i(z)$ with a delay $P_D$, before the delayed ith audio channel representation $C_i(z)$ and the respective ith ambient signal representation $A_i(z)$ are combined:

$$C_i(z)=z^{-P_D}C_i(z)+\gamma A_i(z) \tag{58}$$

As an example, the same delay $P_D$ may be used for delaying at least two audio channel representations of the plurality of audio channel representations, wherein this delay $P_D$ may represent or be based on an average group delay of the decorrelation functions $D_i(z)$ associated with these at least two audio channel representations. Thus, for instance, each of the at least two audio channel representations of the plurality of audio channel representations may be determined based on equation (58). Furthermore, if determining the at least two audio channel representations is performed based on a transfer function introducing the above-mentioned time delay $\tau_H$, the time delay $P_D$ may represent the difference between an average group delay of the decorrelation functions $D_i(z)$ associated with these at least two audio channel representations and the time delay $\tau_H$ introduced by filtering the respective audio channel representations with the respective transfer function.

Furthermore, as an example, before the combining in step 790 is performed, the method may comprise an optional adjustment the amplitude of at least one audio channel signal representation $C_i(n)$ of the plurality of audio channel representations with respect to the amplitude of the second signal representation $S_2(n)$. For instance, due to the filtering operation performed in step 780, the amplitude of at least one audio channel signal representation $C_i(n)$ of the plurality of audio channel representations may not correspond to the amplitude of the second signal representation $S_2(n)$, which serves as a basis for determining a respective ambient signal representation $A_i(n)$ (or $A_i(z)$ in the time domain) associated with an ith audio channel representation $C_i(n)$. Thus, the amplitude of at least one audio channel signal representation $C_i(n)$ of the plurality of audio channel representations may be adjusted in order to correspond with amplitude of the second signal representation $S_2(n)$, before the at least one audio channel signal representation $C_i(n)$ of the plurality of audio channel representations is combined with the respective ambient signal representation as mentioned above with respect to step 790.

For instance, this adjustment may be performed in the frequency-domain or in the time domain. In the sequel, without any limitations, an example of an adjustment in the frequency domain is described, wherein a scaling factor $\epsilon^b$ for adjusting a subband component of a respective audio channel representation may be determined for each subband of the plurality of subbands as follows:

$$\varepsilon^b = \sqrt{\frac{T\left(\sum_{n=n_b}^{n_{b+1}-1} |S_1^b(n)|^2\right)}{\sum_{i=1}^{T}\sum_{n=n_n}^{n_{b+1}-1} |C_i^b(n)|^2}} \tag{59}$$

Accordingly, an adjusted ith audio channel representation $C_i(n)$ may be determined on scaling each subband component $C_i^b(n)$ of the plurality of subband components of the ith audio channel representation $C_i(n)$ with the scaling factor $\epsilon^b$ associated with the respective subband:

$$C_i^b(n)=\epsilon^b C_1^b(n), \tag{60}$$

For instance, this adjustment may be performed for each audio channel representation $C_i(n)$ of the plurality of audio channel representations, before step 790 is performed in order to combine the audio channel representations with the respective ambient signal representations.

Furthermore, as an example, steps 780 and 790 depicted in FIG. 7 might be performed for at least two audio channels of the plurality of audio channels in order to determine at least two audio channel representations associated with these at least two audio channels, wherein said at least two audio channels may represent the plurality of audio channels.

Figure 8:
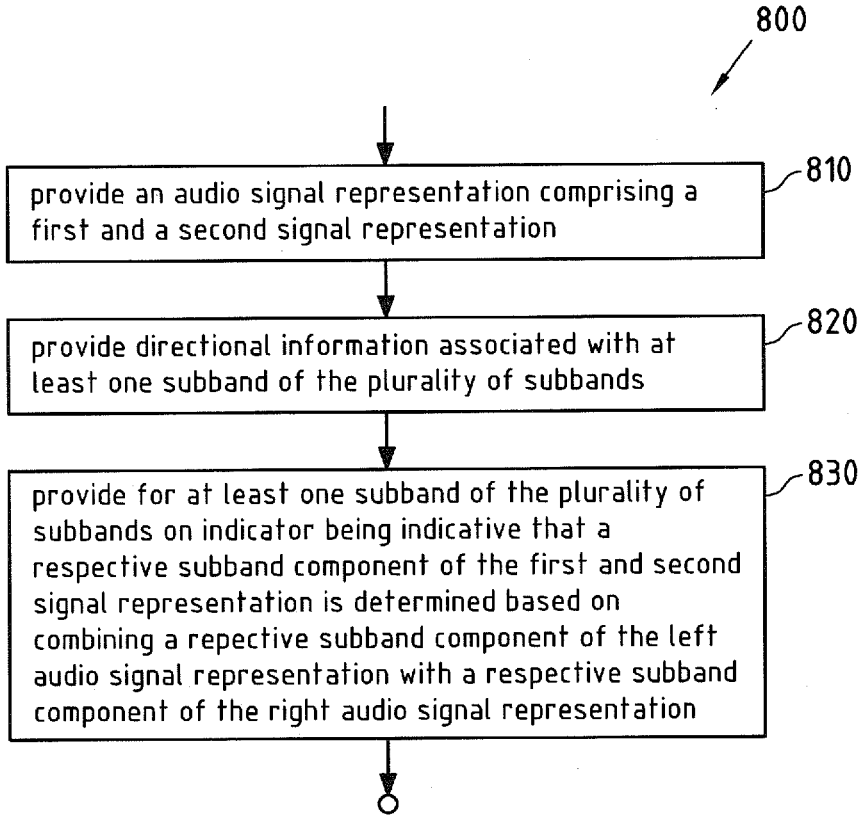
FIG. 8: a flowchart of a first example embodiment of a method according to a third aspect of the invention.

FIG. 8 shows a flowchart 800 of a method according to a first embodiment of a third aspect of the invention. The steps of this flowchart 800 may for instance be defined by respective program code 32 of a computer program 31 that is stored on a tangible storage medium 30, as shown in FIG. 1*b*. Tangible storage medium 30 may for instance embody program memory 11 of FIG. 1*a*, and the computer program 31 may then be executed by processor 10 of FIG. 1*a*.

In step 810, an audio signal representation is provided comprising a first signal representation and a second signal representation.

The first signal representation and the second signal representation may be represented in time domain or in frequency domain.

For instance, the first and/or the second signal representation may be transformed from time domain to frequency domain and vice versa. As an example, the frequency domain representation for the kth signal representation may be represented as $S_k(n)$, with $k\epsilon\{1,2\}$, and $n\epsilon\{0,1,K,N-1\}$, i.e., $S_1(n)$ may represent the first'signal representation in the frequency domain and $S_2(n)$ may represent the second signal representation in the frequency domain. For instance, N may represent the total length of the window considering a sinusoidal window (length $N_s$) and the additional $D_{tot}$ zeros, as will be described in the sequel with respect to an exemplary transform from the time domain to the frequency domain.

Each of the first and second signal representation is associated with a plurality of subbands of a frequency range. For instance, a frequency range in the frequency domain may be divided into the plurality of subbands. The first signal representation comprises a plurality of subband components and the second signal representation comprises a plurality of subband components, wherein each of the plurality of subband components of the first signal representation is associated with a respective subband of the plurality of subbands and wherein each of the plurality of subband components of the second signal representation is associated with a respective subband of the plurality of subbands. Thus, the first signal representation may be described in the frequency domain as well as in the time domain by means the plurality of subband component, wherein the same holds for the second signal representation.

For instance, the subband components may be in the time-domain or in the frequency domain. In the sequel, it may be assumed without any limitation the subband components are in the frequency domain.

As an example, a subband component of a kth signal representation $S_k(n)$ may denoted as $S_k^b(n)$, wherein b may denote the respective subband. As an example, the kth signal representation in the frequency domain may be divided into B subbands $$S_k^b(n)=s_k(n_b+n),\ n=0,K\ n_{b+1}n_b-1,\ b=0,K,B-1, \tag{61}$$

where $n_b$ is the first index of bth subband. The width of the subbands may follow, for instance, the equivalent rectangular bandwidth (ERB) scale.

Furthermore each subband component of at least one subband component of the plurality of subband components of the first signal representation is determined based on a sum of a respective subband component of one of a left audio signal representation and a right audio signal representation shifted by a time delay and of a respective subband component of the other of the left and right audio signal representation, wherein the left audio signal representation is associated with a left audio channel and the right audio signal representation is associated with a right audio channel, the time delay being indicative of a time difference between the left signal representation and the right signal representation with respect to a sound source for the respective subband.

The time-shifted representation of a kth signal representation $X_k^b(n)$ may be expressed as $$X_{k,\tau_b}^b(n) = X_k^b(n)e^{-j\frac{2\pi\tau_b}{N}}. \tag{62}$$

The left audio signal representation is associated with a left audio channel and the right signal representation is associated with a right audio channel, wherein each of the left and right audio signal representations are associated with a plurality of subbands of a frequency range. Thus, in a frequency domain the left signal representation and the right signal representation may each comprise a plurality of subband components, wherein each of the subband components is associated with a subband of the plurality of subbands. For instance, a frequency range in the frequency domain may be divided into the plurality of subbands. Nevertheless, the left and right signal representation may be a representation in the time domain or a representation in the frequency domain. For instance, similar to the notation of the first and the second signal representation, in the frequency domain the left signal representation may be denoted as $X_1(n)$ and the right signal representation may be denoted as $X_2(n)$, wherein a subband component of a the left signal representation may denoted as $X_1^b(n)$, wherein b may denote the respective subband, and wherein a subband component of a the left signal representation $X_2(n)$ may denoted as $X_2^b(n)$, wherein b may denote the respective subband. As an example, the left and right audio signal representation in the frequency domain may be each divided into B subbands as explained above with respect to the first and second signal representation, wherein k=1 or k=2 holds:

$$X_k^b(n)=x_k(n_b+n),\ n=0,K\ n_{b+1}-n_b-1,\ b=0,K,B-1, \tag{63}$$

For instance, the left audio channel may represent a signal captured by a first microphone and the second audio channel may represent a signal captured by a second microphone. As an example, the left audio channel may be captured by microphone 201 and the right audio channel may be captured by microphone 202 depicted in FIG. 2*b*.

Each subband component $S_1^b(n)$ of at least one subband component of the plurality of subband components of the first signal representation $S_1(n)$ is determined based on a sum of a respective subband component of one of the left audio signal representation $X_1(n)$ and the right audio signal representation $X_2(n)$ shifted by a time delay and of a respective subband component of the other of the left $X_1(n)$ and right audio signal representation $X_2(n)$, the time delay being indicative of a time difference between the left signal audio representation $X_1(n)$ and the right audio signal representation $X_2(n)$ with respect to a sound source 205 for the respective subband.

Thus, for instance, the respective subband component of one of the left and right representation shifted by a time delay $\tau_b$ may be the respective subband component $X_1^b(n)$ of the first signal representation shifted by the time delay $\tau_b$, i.e. the respective subband component of one of the left and right signal representation shifted by a time delay may be $X_{1,\tau_b}^b(n)$ (or $X_{1,-\tau_b}(n)$), and the respective subband component of the other of the left and right audio signal representation may be $X_2^b(n)$. Then, a subband component $S_1^b(n)$ of the first signal representation $S_1(n)$ may be determined based on the sum of the respective time shifted subband component of one of the left and right audio signal representation $X_{1,\tau_b}{}^b(n)$ and the respective subband component of the other of the left and right audio signal representation $X_2{}^b(n)$.

The shift of the subband component of the one of the left and right audio signal representation by the time delay $\tau_b$ may be performed in a way that a time difference between the time-shifted subband component (e.g. $X_{1,\tau_b}{}^b(n)$ or $X_{1,-\tau_b}{}^b(n)$) of the one of the left and right audio signal representation and the subband component (e.g. $X_2{}^b(n)$) of the other of the left and right signal representation is at least mostly removed. Thus, the time-shift applied to the subband component (e.g.) $X_1{}^b(n)$ of the one of the left and right audio signal representation enhances or maximizes the correlation or the similarity between the time-shifted subband component (e.g. $X_{1,\tau_b}{}^b(n)$ or $X_{1,\tau_b}{}^b(n)$) of the one of the left and right audio signal representation and the subband component (e.g.) $X_2{}^b(n)$ of the other of the left and right signal representation.

For instance, if a positive time delay $\tau_b$ indicates that the sound comes to the left audio channel (e.g., the first microphone 201) first, then the respective subband component of one of the left and right audio signal representation shifted by a time delay may be $X_{1,\tau_b}{}^b(n)$, and the respective subband component of the other of the left and right audio signal representation may be $X_2{}^b(n)$, and the subband component $S_1{}^b(n)$ may be determined by $$S_1{}^b(n)=X_{1,\tau_b}{}^b(n)+X_2{}^b(n). \tag{64}$$

Thus, the signal component represented by the subband component $X_1{}^b(n)$ is delayed by time delay $\tau_b$, since an audio signal emitted from a sound source 205 reaches the first microphone 201 being associated with the left audio signal representation $X_1(n)$ prior to the second microphone 202 being associated with the right audio signal representation $X_2(n)$.

Or, for instance, if a positive time delay $\tau_b$ indicates that the sound comes to the right audio channel (e.g., the second microphone 202) first, then the respective subband component of one of the left and right audio signal representation shifted by a time delay may be $X_{1,-\tau_b}{}^b(n)$, and the respective subband component of the other of the left and right audio signal representation may be $X_2{}^b(n)$, and the subband component $S_1{}^b(n)$ may be determined by $$S_1{}^b(n)=X_{1,-\tau_b}{}^b(n)+X_2{}^b(n). \tag{65}$$

Or, as another example, the respective subband component of one of the left and right audio representation shifted by a time delay $\tau_b$ may be the respective subband component $X_2{}^b(n)$ of the second signal representation shifted by the time delay $\tau_b$, i.e. the respective subband component of one of the left and right audio signal representation shifted by a time delay may be $X_{2,-\tau_b}{}^b(n)$ (or $X_{2,\tau_b}{}^b(n)$), and the respective subband component of the other of the left and right audio signal representation may be $X_1{}^b(n)$. Then, then subband component $S_1{}^b(n)$ of the first signal representation $S_1(n)$ may be determined based on the sum of the respective time shifted subband component of one of the left and right signal audio representation $X_{2,-\tau_b}{}^b(n)$ (or $X_{2,\tau_b}{}^b(n)$) and the respective subband component of the other of the left and right audio signal representation $X_1{}^b(n)$.

For instance, if a positive time delay $\tau_b$ indicates that the sound comes to the left audio channel (e.g., the first microphone 201) first, then the respective subband component of one of the left and right audio signal representation shifted by a time delay may be $X_{2,-\tau_b}{}^b(n)$, and the respective subband component of the other of the left and right audio signal representation may be $X_1{}^b(n)$, and the subband component $S_1{}^b(n)$ may be determined by $$S_1{}^b(n)=X_1{}^b(n)+X_{2,-\tau_b}{}^b(n). \tag{66}$$

Or, for instance, if a positive time delay $\tau_b$ indicates that the sound comes to the right audio channel (e.g., the second microphone 202) first, then the respective subband component of one of the left and right audio signal representation shifted by a time delay may be $X_{2,\tau_b}{}^b(n)$, and the respective subband component of the other of the left and right audio signal representation may be $X_1{}^b(n)$, and the subband component $S_1{}^b(n)$ may be determined by $$S_1{}^b(n)=X_1{}^b(n)+X_{2,\tau_b}{}^b(n). \tag{67}$$

As an example, under the non-limiting assumption that a positive time delay $\tau_b$ indicates that the sound comes to the left audio channel (e.g., the first microphone 201) first, the subband component $S_1{}^b(n)$ may be determined as follows:

$$S_1^b = \begin{cases} X_1^b + X_{2,-\tau_b}^b, & \tau_b \geq 0 \\ X_1^b + X_{2,-\tau_b}^b, & \tau_b < 0 \end{cases} \tag{68}$$

may hold. Thus, the subband component associated with the channel of the left and right channel in which the sound comes first may be added as such, whereas the subband component associated the channel in which the sound comes later may be shifted. Similarly, for instance, under the non-limiting assumption that a positive time delay $\tau_b$ indicates that the sound comes to the right audio channel (e.g., the second microphone 201) first, the subband component $S_1{}^b(n)$ may be determined as follows:

$$S_1^b = \begin{cases} X_{1,-\tau_b}^b + X_2^b, & \tau_b \geq 0 \\ X_1^b + X_{2,\tau_b}^b, & \tau_b < 0 \end{cases} \tag{69}$$

Furthermore, as an example, it has to be noted that subband component $S_1{}^b(n)$ may be weighted with any factor, i.e. $S_1{}^b(n)$ might be multiplied with a factor f. For instance, f might be f=0.5, or f might be any other value.

Thus, each subband component of the at least one subband component of the plurality of subband components of the first signal representation $S_1(n)$ may be determined as mentioned above. For instance, said at least one subband component may represent the subset of or the complete plurality of subband components of the first signal representation $S_1(n)$.

Each subband component $S_2{}^b(n)$ of at least one subband component of the plurality of subband components of the second signal representation $S_2(n)$ is determined based on a difference between the respective subband component of one of the left and right audio signal representation shifted by the time delay $\tau_b$ and the respective subband component of the other of the left and right audio signal representation.

For instance, for the exemplary scenario explained with respect to equation (64), i.e. $X_{1,\tau_b}{}^b(n)$ representing the respective subband component of one of the left and right audio signal representation shifted by the time delay $\tau_b$ and $X_2{}^b(n)$ representing the respective subband component of the other of the left and right audio signal representation, the corresponding subband component $S_2{}^b(n)$ may be determined by $$S_2{}^b(n)=X_{1,\tau_b}{}^b(n)-X_2{}^b(n). \tag{70}$$

Or, for instance, for the exemplary scenario explained with respect to equation (65), i.e. $X_{1,-\tau_b}{}^b(n)$ representing the respective subband component of one of the left and right audio signal representation shifted by the time delay $\tau_b$ and $X_2{}^b(n)$ representing the respective subband component of the other of the left and right audio signal representation, the corresponding subband component $S_2{}^b(n)$ may be determined by $$S_2{}^b(n)=X_{1,-\tau_b}{}^b(n)-X_2{}^b(n). \tag{71}$$

For instance, for the exemplary scenario explained with respect to equation (66), i.e. $X_1{}^b(n)$ representing the respective subband component of one of the left and right audio signal representation shifted by the time delay $\tau_b$ and $X_{2,-\tau_b}{}^b(n)$ representing the respective subband component of the other of the left and right audio signal representation, the corresponding subband component $S_2{}^b(n)$ may be determined by $$S_2{}^b(n)=X_1{}^b(n)-X_{2,-\tau_b}{}^b(n). \tag{72}$$

Or, for instance, for the exemplary scenario explained with respect to equation (67), i.e. $X_1{}^b(n)$ representing the respective subband component of one of the left and right audio signal representation shifted by the time delay $\tau_b$ and $X_{2,-\tau_b}{}^b(n)$ representing the respective subband component of the other of the left and right audio signal representation, the corresponding subband component $S_2{}^b(n)$ may be determined by $$S_2{}^b(n)=X_1{}^b(n)-X_{2,\tau_b}{}^b(n). \tag{73}$$

As an example, under the non-limiting assumption that a positive time delay $\tau_b$ indicates that the sound comes to the left audio channel (e.g., the first microphone 201) first, the subband component $S_2{}^b(n)$ may be determined as follows:

$$S_2^b = \begin{cases} X_1^b - X_{2,-\tau_b}^b, & \tau_b \geq 0 \\ X_1^b - X_{2,-\tau_b}^b, & \tau_b < 0 \end{cases} \tag{74}$$

may hold. Thus, the subband component associated with the channel of the left and right channel in which the sound comes first may be taken as such, whereas the subband component associated the channel in which the sound comes later may be shifted. Similarly, for instance, under the non-limiting assumption that a positive time delay $\tau_b$ indicates that the sound comes to the right audio channel (e.g., the second microphone 201) first, the subband component $S_2{}^b(n)$ may be determined as follows:

$$S_2^b = \begin{cases} X_{1,-\tau_b}^b - X_2^b, & \tau_b \geq 0 \\ X_1^b - X_{2,\tau_b}^b, & \tau_b < 0 \end{cases} \tag{75}$$

Furthermore, as an example, it has to be noted that subband component $S_2{}^b(n)$ might be weighted with any factor, i.e. $S_2{}^b(n)$ might be multiplied with a factor f. For instance, f might be f=0.5, or f might be any other value. For instance, this weighting factor may be the same weighting factor used for subband component $S_1{}^b(n)$.

Thus, each subband component of the at least one subband component of the plurality of subband components of the second signal representation $S_2(n)$ may be determined as mentioned above. For instance, said at least one subband component may represent the subset of or the complete plurality of subband components of the first signal representation $S_2(n)$.

As an example, said second signal representation $S_2(n)$ may be considered to represent an ambient signal representation generated based on the left and right audio signal representation, wherein this second signal representation $S_2(n)$ may be used to create a perception of an externalization for a sound image.

For instance, the first signal representation $S_1(n)$ may be used as a basis for determining at least one audio channel signal representation of the plurality of audio channel signal representations. As an example, a plurality of audio channel signal representations may represent k audio channel signal representations $C_i(n)$, wherein $i \in \{1,K,k\}$ holds, and wherein $C_i{}^b(n)$ represents a bth subband component of the ith channel signal representation. Thus, an audio channel signal representation $C_i(n)$ may comprise a plurality of subband components $C_i{}^b(n)$, wherein each subband component $C_i{}^b(n)$ of the plurality of subband components may be associated with a respective subband b of the plurality of subbands.

As an example, subband components of an ith audio channel signal representation $C_i(n)$ having dominant sound source directions may be emphasized relative to subbands components of the ith audio channel signal representation $C_i(n)$ having less dominant sound source directions.

For instance, determining at least one audio channel signal representations $C_i(n)$ of the plurality of audio channel signal representations based on the first signal representation $S_1(n)$ and/or the second signal representation $S_2(n)$ may be performed as exemplarily described with respect to the first and second aspect of the invention.

Thus, in step 810 of the method 800 depicted in FIG. 8 an audio signal representation comprising said first signal representation and said second signal representation is performed.

Furthermore, for instance, if the time delay $\tau_b$ for a respective subband b of the at least one subband of the plurality of subbands is not available, the time delay $\tau_b$ of this subband b may be determined based on step 341 of the method depicted in FIG. 3*b* and the explanations given with respect to step 341, i.e., a time delay $\tau_b$ is determined that provides a good or maximized similarity between the respective subband component of one of the left and right audio signal representation shifted by the time delay $\tau_b$ and the respective subband component of the other of the left or right signal representation.

As an example, said similarity may represent a correlation or any other similarity measure.

For instance, for each subband of a subset of subbands of the plurality of subband or for each subband of the plurality of subbands a respective time delay $\tau_b$ may be determined.

Then, in step 342 directional information associated with the respective subband b is determined based on the determined time delay $\tau_b$ associated with the respective subband b.

The time shift $\tau_b$ may indicate how much closer the sound source 215 is to the first microphone 201 than the second microphone 202. With respect to exemplary predefined geometric constellation depicted in FIG. 2*b*, when $\tau_b$ is positive, the sound source 205 is closer to the second microphone 202, and when $\tau_b$ is negative, the sound source 205 is closer to the first microphone 201.

Furthermore, in step 820, directional information associated with at least one subband of the plurality of subbands is provided. For instance, the directional information is at least partially indicative of a direction of a sound source with respect to the left and right audio channel, the left audio channel being associated with the left audio signal representation and the right audio channel being associated with the right audio signal representation. For instance, the at least one subband of the plurality of subbands may represent a subset of subbands of the plurality of subbands or may represent the plurality of subbands associated with the left and the right signal representation.

For instance, the directional information may be indicative of the direction of a dominant sound source relative to a first and a second microphone for a respective subband of the at least one subband of the plurality of subbands.

As an example, the illustration of an example of a microphone arrangement depicted in FIG. 2*b* might for instance be used for capturing the left and right audio channel Thus, the explanations given with respect to FIG. 2*b* also hold for any method of the third aspect of the invention.

The directional information provided in step 820 of the method depicted in FIG. 8 may comprise an angle $\alpha_b$ representative of arriving sound relative to the first microphone 201 and second microphone 202 for a respective subband b of the at least one subband of the plurality of subbands associated with the left and right audio signal representation. As exemplarily depicted in FIG. 2*b*, the angle $\alpha_b$ may represent the incoming angle $\alpha_b$ with respect to one microphone 202 of the two or more microphones 201, 202, 203, but due to the predetermined geometric configuration of the at least two microphones 201, 202, 203, this incoming angel $\alpha_b$ can be considered to represent an angle $\alpha_b$ indicative of the sound source 205 relative to the first and second microphone for a respective subband b.

As an example, the directional information may be determined by means of a directional analysis based on the left and right audio signal representation. For instance, any of the directional analysis described above may be used for determining the directional information, in particular the exemplary directional analysis described with respect to the method depicted in FIG. 3*a*.

Furthermore, in step 830 of the method 800 depicted in FIG. 8, for at least one subband of the plurality of subbands it is provided an indicator being indicative that a respective subband component of the first and second signal representation is determined based on combining a respective subband component of the left audio signal representation with a respective subband component of the right audio signal representation.

For instance, said combining may comprise adding or subtracting, as mentioned above with respect to determining the subband components of the first and second signal representation.

As an example, an indicator may be provided being indicative that a subband component $S_1^b(n)$ of the first signal representation $S_1(n)$ and the respective subband component $S_2^b(n)$ of the second signal representation $S_2(n)$, i.e., both subband components $S_1^b(n)$ and $S_2^b(n)$ are associated with the same subband b, is determined based on combining a respective subband component $X_1^b(n)$ of the left audio signal representation with a respective subband component $X_2^b(n)$ of the right audio signal representation. It has to be understood that one of the respective subband components $X_1^b(n)$ and $X_2^b(n)$ of the left and right audio signal representation may be time-shifted.

For instance, said indicator may be provided for each subband of a subset of subband of the plurality of subbands or for each subband of the plurality of subbands. Furthermore, as an example, a single one indicator may be provided indicating that the combining is performed for each subband.

As an example, said indicator may represent a flag indicating that a coding based on combining is applied. For instance, said coding may represent a Mid/Side-Coding, wherein the first signal representation may be considered as a mid signal representation and the second signal representation may be considered as a side signal representation.

Furthermore, an encoded audio representation may be provided comprising the first and second signal representation, the directional information and the at least one indicator.

Figure 9A:
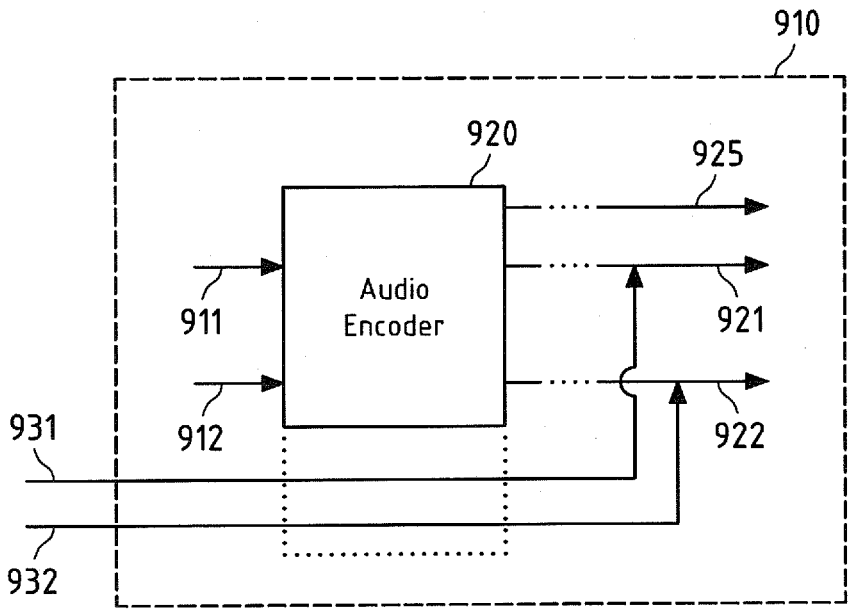
FIG. 9*a*: a schematic block diagram of an example embodiment of an apparatus according to the third aspect of invention.

FIG. 9*a* depicts a schematic block diagram of an example embodiment of an apparatus 910 according to the third aspect of invention. This apparatus 910 will be explained in conjunction with the flowchart of a second example embodiment of a method according to the third aspect of the invention depicted in FIG. 9*b*.

The apparatus 910 comprises an audio encoder 920 which is configured to receive a first input signal representation 911 and a second input signal representation 912 and which is configured to determine a first encoded audio signal representation 921 and a second encoded audio signal representation 922 based on the first and second input signal representation 911, 912, wherein in accordance with a first audio codec the audio encoder 920 is basically configured to encode at least one subband component of the first input signal representation 911 and the respective at least one subband component of the second input signal 912 in accordance with a first audio codec based on combining a subband component of the at least one subband component of the first input signal representation with the respective subband component of the at least one subband component of the second input signal representation in order to determine a respective subband component of the first encoded audio signal and a respective subband component of the second encoded audio signal and to provide for at least one subband of the plurality of subbands associated with the at least one subband component of the first input signal representation and with the at least one subband component of the second input signal representation an audio codec indicator being indicative that the first audio coded is used for encoding this at least one subband of the plurality of subbands.

For instance, under the non-limiting assumption that $I_1(n)$ may represent the first input signal representation 911 in the frequency domain and $I_1^b(n)$ represents a bth subband component of the first input signal representation 911 associated with subband b of the plurality of subbands, and under the non-limiting assumption that $I_2(n)$ may represent the second input signal representation 912 in the frequency domain and $I_2^b(n)$ represents a bth subband component of the first input signal representation 911 associated with subband b of the plurality of subbands, the first audio coded may be applied to at least one subband of the plurality of subband, wherein for each subband of at least one subband of the plurality of subbands the encoder 920 is configured to determine a respective subband component $A_1^b(n)$ of the first encoded audio representation $A_1(n)$ based on combining the respective subband component $I_1^b(n)$ of the first input signal representation $I_1(n)$ with the respective subband component component $I_2^b(n)$ the second input signal representation $I_2(n)$, to determine a respective subband component $A_2^b(n)$ of the second encoded audio representation $A_2(n)$ based on combining the respective subband component $I_1^b(n)$ of the first input signal representation $I_1(n)$ with the respective subband component component $I_2^b(n)$ the second input signal representation $I_2(n)$, and, optionally, to provide an audio codec indicator 925 being indicative that the respective subband is encoded in accordance with the first audio codec.

For instance, said combining in accordance with the first audio codec may include determining a subband component $A_1^b(n)$ of the first encoded audio representation $A_1(n)$ based an a sum of the respective subband component $I_1^b(n)$ of the first input signal representation $I_1(n)$ and the respective subband component component $I_2^b(n)$ the second input signal representation $I_2(n)$. For instance, said sum may be determined as follows:

$$A_1^b(n)=I_1^b(n)+I_2^b(n) \tag{76}$$

It has to be noted that determined subband component $A_1^b(n)$ may be weighted with any factor, i.e. $A_1^b(n)$ might be multiplied with a factor w. For instance, w might be f=0.5, or w might be any other value.

For instance, said combining in accordance with the first audio codec may include determining a subband component $A_2^b(n)$ of the first encoded audio representation $A_2(n)$ based an a difference of the respective subband component $I_1^b(n)$ of the first input signal representation $I_1(n)$ and the respective subband component component $I_2^b(n)$ the second input signal representation $I_2(n)$. For instance, said difference may be determined as follows:

$$A_1^b(n)=I_1^b(n)-I_2^b(n) \tag{77}$$

It has to be noted that the determined subband component $A_1^b(n)$ may be weighted with any factor, i.e. $A_1^b(n)$ might be multiplied with a factor w. For instance, w might be f=0.5, or w might be any other value.

As an example, the audio encoder 920 may be basically configured to select for each subband of at least one subband of the plurality of subbands whether to perform audio encoding of the respective subband component of the first input signal representation and the respective subband component of the second input signal representation in accordance with the first audio codec or in accordance with a further audio codec, wherein the further audio codec represents an audio codec being different from the first audio codec. Furthermore, the audio indicator 925 may be configured to identify for each subband of the at least one subband of the plurality of subbands which audio coded is chosen for the respective subband.

In accordance with the second example embodiment of a method according to the third aspect of the invention, at step 980 the first signal representation 931 and the second signal representation 932 are fed to the audio encoder 920 and the first audio codec is selected at the audio encoder 920. Said selection may comprise selection the first audio coded for at least one subband of the plurality of subbands, e.g. for a subset of subbands of the plurality of subbands or for each subbands of the plurality of subbands.

Furthermore, in step 990, the method comprises bypassing the combining associated with the first audio codec such that the first encoded audio representation $A_1(n)$ 921 represents the first signal representation $S_1(n)$ 931 and that the second encoded audio representation $A_2(n)$ 922 represents the second signal representation $S_2(n)$ 932.

Thus, for instance, the determining of the first and second encoded audio representations $A_1(n)$, $A_2(n)$ in audio encoder 920 is bypassed by feeding the first signal representation $S_1(n)$ 931 to the output of the audio encoder 920 in such a way that the first encoded audio representation $A_1(n)$ 921 represents the first signal representation $S_1(n)$ 931 and by feeding the second signal representation $S_2(n)$ 932 to the output of the audio encoder 920 in such a way that the second encoded audio representation $A_2(n)$ 922 represents the second signal representation $S_2(n)$ 932.

Since the first audio codec is selected in step 980, the audio encoder 920 outputs an audio codec indicator 925 being indicative that the at least one subband of the plurality of subbands is encoded in accordance with the first audio codec, wherein the at least one subband may for instance be a subset of subbands of the plurality of subbands or all subbands of the plurality of subbands.

This audio codec indicator 925 provided for the at least one subband of the plurality of subbands is used as said indicator being indicative that a respective subband of the first and second signal representation is determined based on combining a respective subband component of the left audio signal representation with a respective subband component of the right audio signal representation provided in step 830 of method 800 depicted in FIG. 8.

Furthermore, the first encoded audio representation $A_1(n)$ 931 represents the first signal representation and the second encoded audio representation $A_2(n)$ represents the second signal representation provided in step 810 of method 800 depicted in FIG. 8.

Figure 9B:
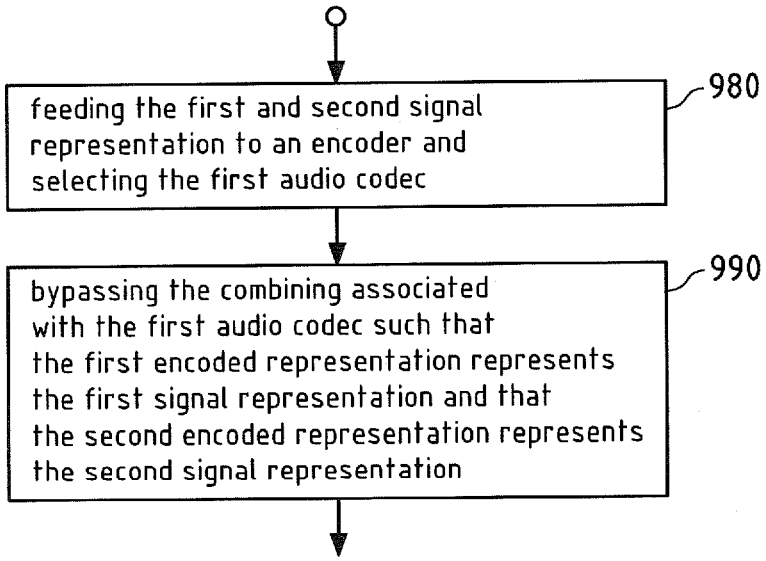
FIG. 9*b*: a flowchart of a second example embodiment of a method according to the third aspect of the invention.
Figure 9C:
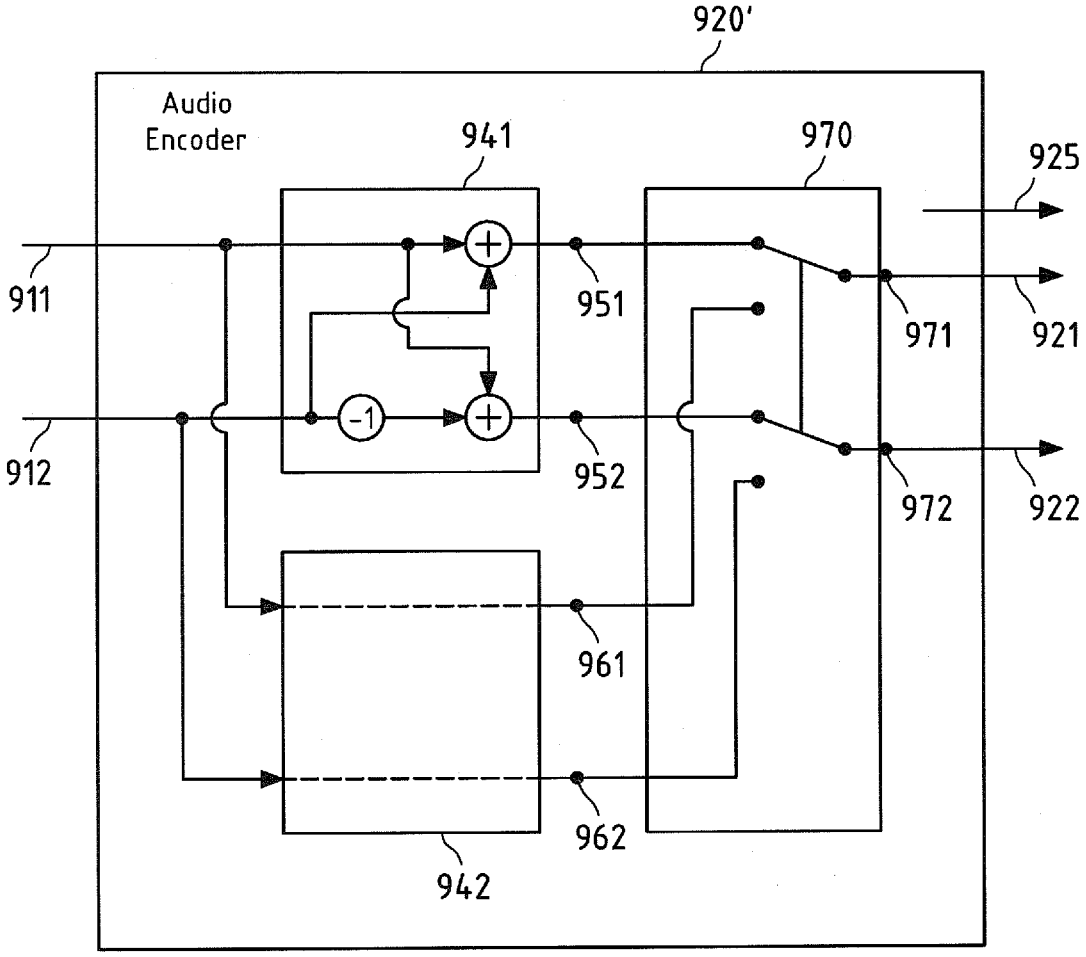
FIG. 9*c*: a schematic block diagram of an example embodiment of an audio encoding apparatus according to the third aspect of invention.

FIG. 9*c* represents a schematic block diagram of an example embodiment of an audio encoder 910' according to the third aspect of invention, which may be used for the audio encoder depicted in FIG. 9*a* in order to realize the bypass function performed in step 990 of the method depicted in FIG. 9.

The audio encoder 910' comprises a combining entity 941 which is configured to combine, for each subband of at least one subband of the plurality of subbands, the respective subband component component $I_1^b(n)$ of the first input signal representation $I_1(n)$ and the respective subband component component $I_2^b(n)$ the second input signal representation $I_2(n)$ in accordance with the first audio codec in order to determine a first encoded audio representation $A_1(n)$ 951 and in order to determine a second encoded audio representation $A_2(n)$ 952, as described above.

For instance, as exemplarily disclosed in FIG. 9*c*, said combining may comprise determining a subband component $A_1^b(n)$ of the first encoded audio representation $A_1(n)$ based an a sum of the respective subband component $I_1^b(n)$ of the first input signal representation $I_1(n)$ and the respective subband component component $I_2^b(n)$ the second input signal representation $I_2(n)$ and may comprise determining a subband component $A_2^b(n)$ of the first encoded audio representation $A_2(n)$ based an a difference of the respective subband component $I_1^b(n)$ of the first input signal representation $I_1(n)$ and the respective subband component component $I_2^b(n)$ the second input signal representation $I_2(n)$.

Furthermore, the audio encoder 920' may comprise at least one further entity 942 (FIG. 9*c* only depicts one further entity 942), wherein one of this at least one further entity 942 may be configured to perform a further audio codec, wherein a first encoded audio representation 961 and a second encoded audio representation 962 associated with the further audio coded may be outputted at the respective further entity.

The audio encoder 920' further comprises a switching entity 970 which is configured to select an output of one of the combining entity 941 and the at least one further entity 942 for each subband of the at least one subband of the plurality of subbands to output the selected signals at outputs 971 and 972, respectively.

For instance, one entity 942 of the at least one further entity 942 may be configured to pass through the first input signal representation and the second input signal representation, as exemplarily indicated by the dashed lines in the further entity 942.

Thus, the bypass performed in step 990 in FIG. 9*b* may be performed by feeding the first signal representation $S_1(n)$ 931 in the apparatus 910 and in the input 911 of the audio encoder 910', by feeding the second signal representation $S_2(n)$ 932 in the apparatus 910 and in the input 912 of the audio encoder 910', and by controlling the switching entity 970 in order to select the output of the further entity 942 as signal being outputted by the audio encoder 921' as first encoded representation 921 and second encoded representation 922 for each subband of the at least one subband of the plurality of subbands. Furthermore, the audio encoder 920' outputs an audio codec indicator 925 being indicative that the at least one subband of the plurality of subbands is encoded in accordance with the selected first audio codec. For instance, the at least one subband may for instance be a subset of subbands of the plurality of subbands or all subbands of the plurality of subbands.

Accordingly, the term "bypass" has to be understood in a way that the first encoded signal representation 921 and the second encoded signal representation 922 outputted by the audio encoder 910, 910' does not depend or is not influenced by the combining operation of the first audio coded, e.g. as performed by the combining entity 941.

Thus, as an example, the first and second signal representation may be bypassed with respect to the combining operation of the first audio codec in a way that the first signal representation is outputted by the audio decoder 920' as the first encoded representation and the second signal representation is outputted by the audio decoder 921' as the second encoded representation.

Figure 10:
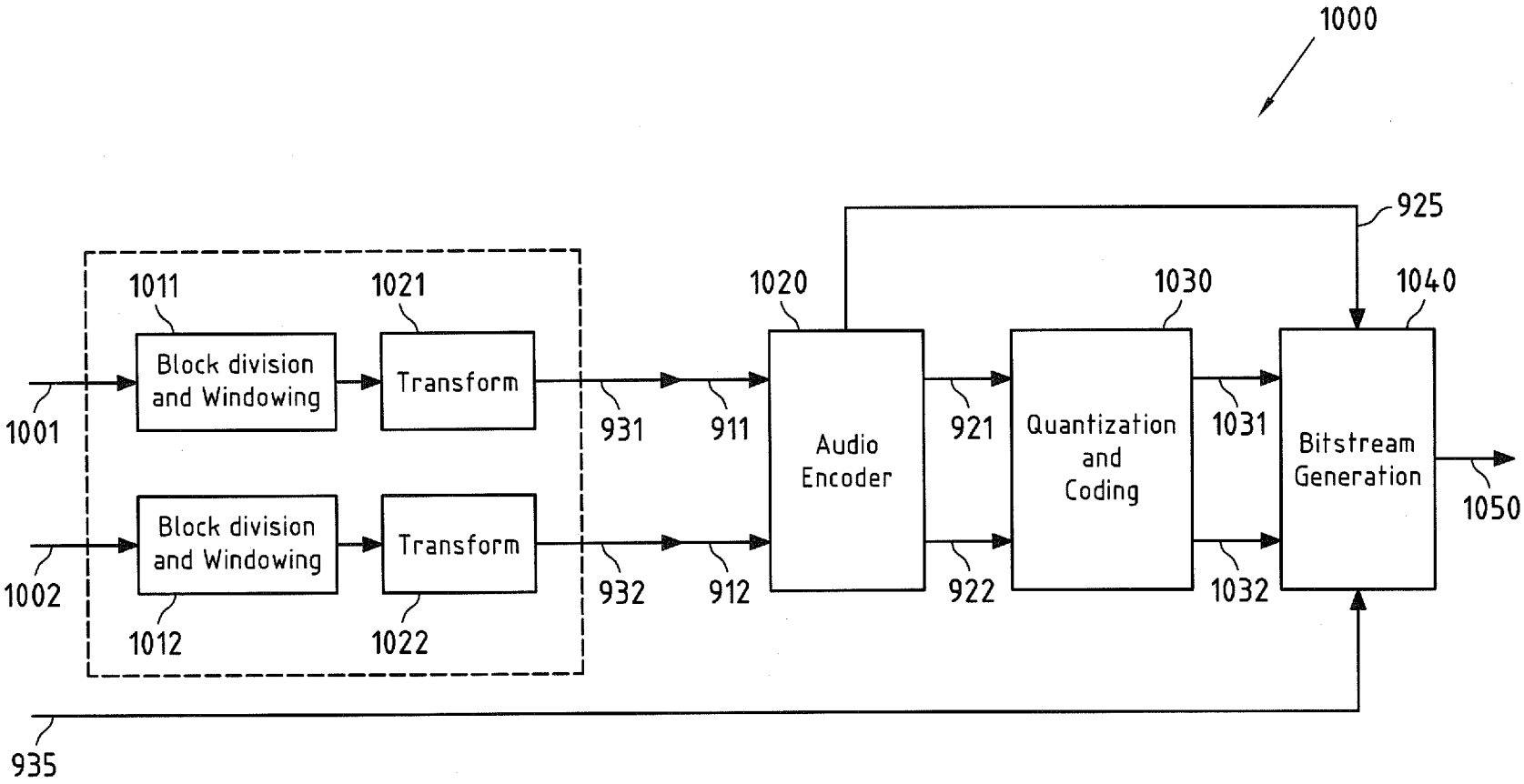
FIG. 10: a schematic block diagram of a second example embodiment of an apparatus according to the third aspect of invention.

FIG. 10 depicts a schematic block diagram of a second example embodiment of an apparatus 1000 according to the third aspect of invention.

For instance, this apparatus 1000 may be based on the apparatus 910 depicted in FIG. 9. The apparatus 1000 comprises an audio encoder 1020, which may represent the audio encoder 920 depicted in FIG. 9*a* or the audio encoder 920' depicted in FIG. 9*c*.

In FIG. 10, the first signal representation is indicated by reference sign 1001 and the second signal representation is indicated by reference sign 1002.

If the first and second signal representation 1001, 1002 are not in the frequency-domain, i.e., if the first and the second signal representation are in the time domain then the first signal representation 1001 is fed to an optional entity for block division and windowing 1011, wherein this entity 1011 may be configured to generate windows with a predefined overlap and an effective length, wherein this predefined overlap map represent 50 or another well-suited percentage, and wherein this effective length may be 20 ms or another well-suited length.

Furthermore, the entity 1011 may be configured to add $D_{tot}=D_{max}+D_{HRTF}$ zeroes to the end of the window, wherein $D_{max}$ may correspond to the maximum delay in samples between the microphones, as explained with respect to the method depicted in FIG. 3.

Similarly, the optional entity for block division and windowing 1012 may receive the second signal representation and is configured to generate windows with a predefined overlap and an effective length in the same way as optional entity 1011.

The windows formed by entities configured to generate windows with a predefined overlap and an effective length 1011, 1012 are fed to the respective optional transform entity 1021, 1022, wherein transform entity 1021 is configured to transform the windows of the first signal representation 1001 to frequency domain, and wherein transform entity 1022 is configured to transform the windows of the second signal representation 1002 to frequency domain. This may be done in accordance with the explanation presented with respect to step 320 of FIG. 3*a*.

Thus, transform entity 421 may be configured to output $S_1(n)$ and transform entity 422 may be configured to output $S_2(n)$.

If the first and second signal representation 1001, 1002 are in the frequency-domain, then optional entities 1011, 1012, 1021 and 1022 may be omitted and the first signal representation 1001 can be used as first signal representation 931 which is fed as input signal 911 to the audio encoder 1020 and the second signal representation 1002 can be used as second signal representation 932 which is fed to the audio encoder 1020.

The audio encoder 1020 outputs the first encoded signal representation 921 and the second encoded signal representation 922, as explained above. Furthermore, the audio encoder 1020 outputs an audio codec indicator 925 being indicative that the at least one subband of the plurality of subbands is encoded in accordance with the selected first audio codec, as explained above.

Entity 1030 is configured to perform quantization end encoding to the first encoded signal representation $A_1(n)$ in the frequency domain and to the second encoded signal representation $A_2(n)$ in the frequency domain For instance, suitable audio codes may for instance be AMR-WB+, MP3, AAC and AAC+, or any other audio codec.

Afterwards, the quantized and encoded first and second signal representations 1031, 1032 are inserted into a bitstream 1050 by means of bitstream generation entity 1040.

The directional information 935 associated with at least one subband of the plurality of subbands associated with the left and the right signal representation is inserted into the bitstream 1005 by means of the bitstream generation entity 440. Furthermore, for instance, the directional information 403 may be quantized and/or encoded before being inserted in the bitstream 1005. This may be performed by entity 1030 (not depicted in FIG. 10).

Thus, the apparatus 1000 is configured to output an encoded audio representation 1050 comprising the first and second signal representation 1001, 1002, the directional information 935, and the indicator 935.

Figure 11:
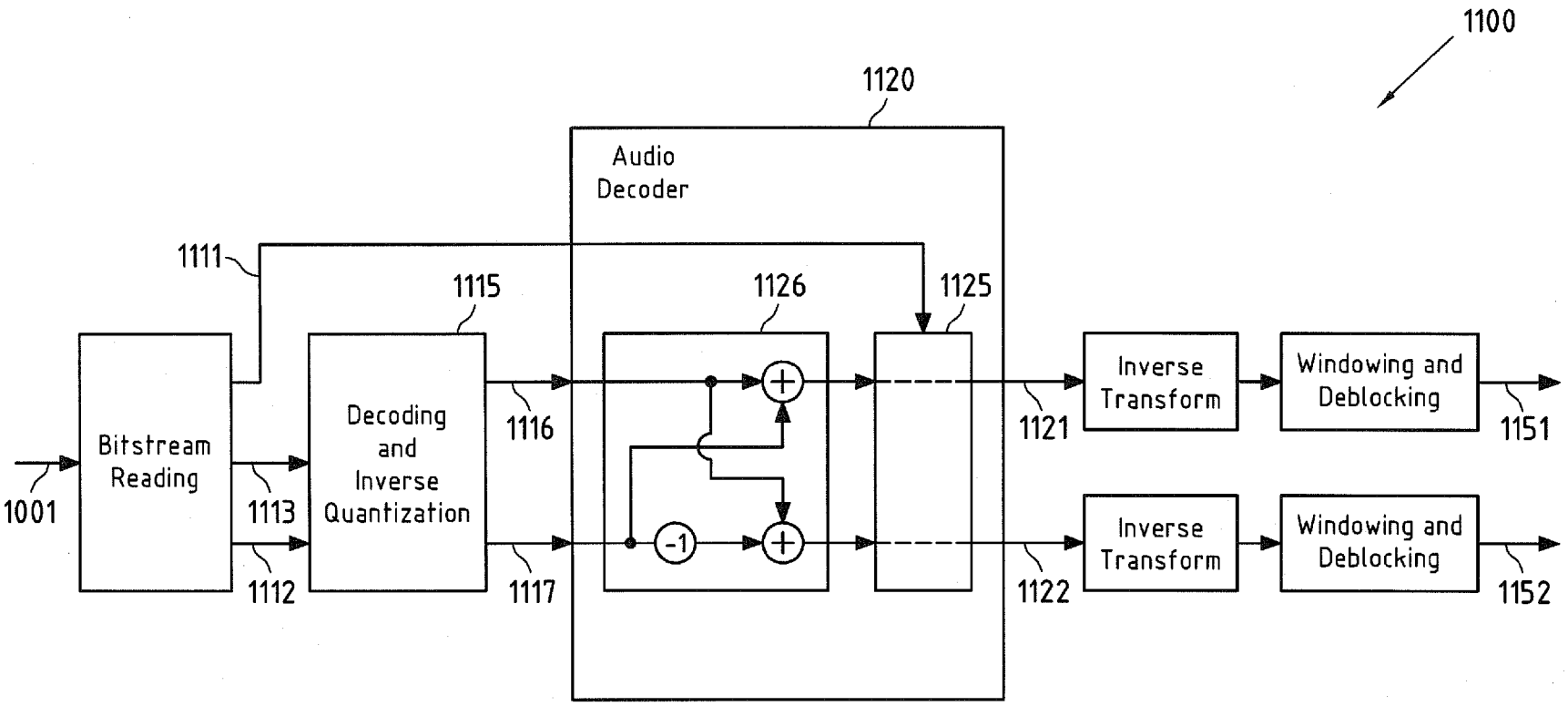
FIG. 11: a schematic block diagram of a third example embodiment of an apparatus according to the third aspect of invention.

As will be exemplarily described with respect to the apparatus 1100 depicted in FIG. 11, the encoded audio representation 1050 might be considered to represent a backward compatible audio representation which may be encoded to the left and right signals by an audio decoder which is configured to perform audio decoding according to the first audio codec.

Apparatus 1100 comprises an audio decoder 1120, which is configured to receive a first encoded signal representation 1116 and a second signal representation 1117 and which is configured to perform an audio decoding in accordance with the first audio codec for each subband which is indicated to be encoded with the first audio coded by the indicator 1111.

The apparatus 1100 receives an encoded audio representation 1101, which may represent or be based on the encoded audio representation 1050 depicted in FIG. 10.

A bitstream entity 1110 is configured to extract the indicator from the encoded audio representation 1101, which is fed as indicator 1111 to the audio decoder 1120. Furthermore, the bitstream entity feeds the encoded first and second signal representation 1112, 1113 to an entity for decoding and inverse quantization 1115. This entity for decoding and inverse quantization 1115 may represent the counterpart to the entity for quantization and coding 1030 depicted in FIG. 10, i.e. the entity for decoding and inverse quantization 1115 is configured to perform a decoding being inverse to the coding performed in entity 1030 and to perform an inverse quantization being inverse to the quantization performed in entity 1030 at least to the first and second encoded signal representation.

Accordingly, the entity for decoding and inverse quantization 1115 is configured to output the first and second encoded signal representation 1116, 1117, which are fed to the audio decoder 1120 mentioned above.

Then, in accordance with the indicator 1111, audio decoding is performed for each subband of the first subband by the decombining entity 1126, wherein this decombining entity 1126 is configured to reverse the combining performed by the audio encoder 1020 in accordance with the first audio codec.

For instance, said decombining may comprise for each subband of the at least one subband indicated by the indicator 1111 as been encoded by the first audio codec determining a respective subband component $D_1^b(n)$ of a decoded first audio signal representation 1121 $D_1(n)$ based on a sum of the respective subband component $A_1^b(n)$ of the first encoded signal representation 1116 $A_1(n)$ and the respective subband component $A_2^b(n)$ of the second encoded signal representation 1117 $A_2(n)$ and determining a respective subband component $D_2^b(n)$ of a decoded second audio signal representation 1122 $D_2(n)$ based on a difference of the respective subband component $A_1^b(n)$ of the first encoded signal representation 1116 $A_1(n)$ and the respective subband component $A_2^b(n)$ of the second encoded signal representation 1117 $A_2(n)$.

For instance, for each subband indicated by the indicator 1111, the respective decoding in accordance with the first audio codec may be performed as follows:

$$D_1^b(n)=A_1^b(n)+A_2^b(n),$$

$$D_2^b(n)=A_1^b(n)-A_2^b(n) \tag{78}$$

It has to be noted that each subband component $D_1^b(n)$ and $D_2^b(n)$ might be weighted with any factor, i.e. $D_1^b(n)$ and $D_2^b(n)$ might be multiplied with a factor f. For instance, f might be f=0.5, or f might be any other value.

Accordingly, the decoded first audio signal representation 1121 $D_1(n)$ represents the left audio signal representation and the decoded second audio signal representation 1122 $D_2(n)$ represents the right audio signal representation.

Thus, the encoded audio signal representation in accordance with the third aspect of the invention can be used for playing back the left and right channel by means of an audio decoder which is capable to decode the first audio codec.

Furthermore, the encoded audio signal representation in accordance with the third aspect of the invention may also be used for determining a binaural or multichannel audio signal representation based on the directional information, wherein this may be performed in accordance with any method described with respect to the first or second aspect of the invention.

The apparatus 1110 may further comprise an inverse transform entity 1131 being configured to inverse transform the first decoded signal and an inverse transform entity 1132 being configured to inverse transform the second decoded signal, for instance by means of an inverse DFT.

Furthermore, the apparatus 1110 may comprise an entity 1141 for windowing and deblocking which may be configured to apply a sinusoidal windowing, and, if overlap has been used for transform to frequency domain, by combing the overlapping frames of adjacent frames. Accordingly, a time domain representation of the decoded first signal representation 1151 may be outputted by the entity 1141. Similarly, entity 1142 for windowing and deblocking may output a time domain representation of the decoded second signal representation 1152.

It has to be understood that any features and explanation of one of the first, second and third aspect of the invention may be used for any other aspect of the first, second and third aspect and vice versa.

As used in this application, the term 'circuitry' refers to all of the following:

(a) hardware-only circuit implementations (such as implementations in only analog and/or digital circuitry) and (b) combinations of circuits and software (and/or firmware), such as (as applicable):

(i) to a combination of processor(s) or (ii) to portions of processor(s)/software (including digital signal processor(s)), software, and memory(ies) that work together to cause an apparatus, such as a mobile phone or a positioning device, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a positioning device.

As used in this application, the wording "X comprises A and B" (with X, A and B being representative of all kinds of words in the description) is meant to express that X has at least A and B, but can have further elements. Furthermore, the wording "X based on Y" (with X and Y being representative of all kinds of words in the description) is meant to express that X is influenced at least by Y, but may be influenced by further circumstances. Furthermore, the undefined article "a" is—unless otherwise stated—not understood to mean "only one".

The invention has been described above by means of embodiments, which shall be understood to be non-limiting examples. In particular, it should be noted that there are alternative ways and variations which are obvious to a skilled person in the art and can be implemented without deviating from the scope and spirit of the appended claims. It should also be understood that the sequence of method steps in the flowcharts presented above is not mandatory, also alternative sequences may be possible.

The invention claimed is:

1. A method comprising:

providing a left audio channel signal and a right audio channel to an encoder, wherein the encoder is configured to determine a first encoded audio channel signal and a second encoded audio channel signal;

combining, using a first audio codec of the encoder, at least one sub band component of the left audio channel signal with a respective sub band component of the right audio channel signal in order to determine a respective at least one sub band component of the first encoded audio channel signal and a respective at least one sub band component of the second encoded audio channel signal;

providing, an audio codec indicator for the at least one sub band, wherein the audio codec indicator is indicative that the first audio codec is used for encoding the at least one sub band;

selecting the first audio codec of the encoder; and bypassing the combining with the first audio codec, such that the first encoded audio channel signal is the left audio channel signal and the second encoded audio channel signal is the right audio channel signal, wherein the audio codec indicator provided for the at least one sub band indicates that the at least one sub band of the first and second encoded audio channel signal is determined based on combining a respective sub band component of the left audio channel signal with a respective sub band component of the right audio channel signal.

2. The method as claimed in claim 1 further comprising:

providing directional information associated with the least one sub band of the left and the right audio channel signal, the directional information being at least partially indicative of a direction of a sound source with respect to the left and right audio signal channel.

3. The method as claimed in claim 2, wherein said left audio signal channel is captured by a first microphone and said right audio signal channel is captured by a second microphone of two or more microphones arranged in a predetermined geometric configuration.

4. The method as claimed in claim 3, wherein the directional information is indicative of the direction of the sound source relative to the first and second microphone for the at least one sub band of the left and the right audio channel signal.

5. The method as claimed in claim 4, wherein the directional information comprises an angle representative of arriving sound relative to the first and second microphones for the at least one sub band of the left and the right audio channel signal.

6. The method as claimed in claim 4, wherein the directional information comprises a time delay for a respective sub band of the at least one sub band of the left and the right audio channel signal, the time delay being indicative of a time difference between the left audio channel signal and the right audio signal channel with respect to the sound source for the at least one sub band.

7. The method as claimed in claim 4, wherein the directional information comprises at least one of the following distances:

a distance indicative of the distance between the first and second microphone, and a distance indicative of the distance between the sound source and a microphone of the first and second microphone.

8. The method as claimed in claim 1, wherein the combining the at least one sub band component of the left audio channel signal with a respective sub band component of the right audio channel signal in order to determine a respective at least one sub band component of the first encoded audio channel signal and a respective at least one sub band component of the second encoded audio channel signal comprises:

determining the sum of the at least one sub band component of the left audio signal and the respective sub band component of the right audio channel signal in order to determine a respective at least one sub band component of the first encoded audio channel signal; and determining the difference between the at least one sub band component of the left audio signal and the respective sub band component of the right audio channel signal in order to determine a respective at least one sub band component of the second encoded audio channel signal.

9. An Apparatus comprising at least one processor and at least one memory including computer code for one or more programs, the at least one memory and the computer code configured to with the at least one processor cause the apparatus to at least:

provide a left audio channel signal and a right audio channel to an encoder, wherein the encoder is configured to determine a first encoded audio channel signal and a second encoded audio channel signal;

combine, using a first audio codec of the encoder, at least one sub band component of the left audio channel signal with a respective sub band component of the right audio channel signal in order to determine a respective at least one sub band component of the first encoded audio channel signal and a respective at least one sub band component of the second encoded audio channel signal;

provide an audio codec indicator for the at least one sub band, wherein the audio codec indicator is indicative that the first audio codec is used for encoding the at least one sub band;

select the first audio codec of the encoder; and bypass the first audio codec such that the first encoded audio channel signal is the left audio channel signal and the second encoded audio channel signal is the right audio channel signal, wherein the audio codec indicator provided for the at least one sub band indicates that the at least one sub band of the first and second encoded audio channel signal is determined based on combining a respective sub band component of the left audio channel signal with a respective sub band component of the right audio channel signal.

10. The apparatus as claimed in claim 9, where in the apparatus is further caused to:

provide directional information associated with the least one sub band of the left and the right audio channel signal, the directional information being at least partially indicative of a direction of a sound source with respect to the left and right audio signal channel.

11. The apparatus as claimed in claim 10, wherein said left audio signal channel is captured by a first microphone and said right audio signal channel is captured by a second microphone of two or more microphones arranged in a predetermined geometric configuration.

12. The apparatus as claimed in claim 11, wherein the directional information is indicative of the direction of the sound source relative to the first and second microphone for the at least one sub band of the left and the right audio channel signal.

13. The apparatus as claimed in claim 12, wherein the directional information comprises an angle representative of arriving sound relative to the first and second microphones for the at least one sub band of the left and the right audio channel signal.

14. The apparatus as claimed in claim 12, wherein the directional information comprises a time delay for a respective sub band of the at least one sub band of the left and the right audio channel signal, the time delay being indicative of a time difference between the left audio channel signal and the right audio signal channel with respect to the sound source for the at least one sub band.

15. The apparatus as claimed in claim 12, wherein the directional information comprises at least one of the following distances:

a distance indicative of the distance between the first and second microphone, and a distance indicative of the distance between the sound source and a microphone of the first and second microphone.

16. The apparatus as claimed in claim 9, wherein the apparatus caused to combine the at least one sub band component of the left audio channel signal with a respective sub band component of the right audio channel signal in order to determine a respective at least one sub band component of the first encoded audio channel signal and a respective at least one sub band component of the second encoded audio channel signal is further caused to:

determine the sum of the at least one sub band component of the left audio signal and the respective sub band component of the right audio channel signal in order to determine a respective at least one sub band component of the first encoded audio channel signal; and determine the difference between the at least one sub band component of the left audio signal and the respective sub band component of the right audio channel signal in order to determine a respective at least one sub band component of the second encoded audio channel signal.

* * * * *